US005915815A

United States Patent [19]

Moore et al.

[11] Patent Number: 5,915,815

[45] Date of Patent: Jun. 29, 1999

[54] METHOD AND APPARATUS FOR DRYING ORGANIC MATERIAL

[75] Inventors: Philip Moore, Upper Benfield Oundle; David J Dickinson, Yardley Hastings, both of United Kingdom

[73] Assignee: Responsible Recycling Limited, Upper Benfield, United Kingdom

[21] Appl. No.: 08/913,619

[22] PCT Filed: Mar. 25, 1996

[86] PCT No.: PCT/GB96/00704

§ 371 Date: Sep. 23, 1997

§ 102(e) Date: Sep. 23, 1997

[87] PCT Pub. No.: WO96/29557

PCT Pub. Date: Sep. 26, 1996

[30] Foreign Application Priority Data

Mar. 23, 1995 [GB] United Kingdom ..... 9505857

[51] Int. Cl.[6] ..... F26B 5/00

[52] U.S. Cl. ..... 34/305; 34/378; 34/469; 34/499; 34/79; 34/132; 34/169

[58] Field of Search ..... 34/305, 327, 378, 34/417, 469, 499, 500, 68, 69, 77, 79, 92, 131, 132, 169; 99/403, 410–415; 426/438, 495, 599; 202/161, 175, 185.5; 203/40, 80, 90; 554/10, 12, 15, 20

[56] References Cited

U.S. PATENT DOCUMENTS

| | | | |
|---|---|---|---|
| 3,718,485 | 2/1973 | Lankford | 99/204 |
| 4,140,478 | 2/1979 | Kawakami et al. | 432/13 |
| 4,257,945 | 3/1981 | Martel | 512/5 |
| 4,332,092 | 6/1982 | Hansotte | 34/515 |
| 4,406,745 | 9/1983 | Martel | 202/161 |
| 4,864,942 | 9/1989 | Fochtman et al. | 110/226 |
| 5,041,245 | 8/1991 | Benado | 554/10 |

FOREIGN PATENT DOCUMENTS

WO 9420804 9/1991 WIPO .

*Primary Examiner*—Henry Bennett
*Assistant Examiner*—Steve Gravini
*Attorney, Agent, or Firm*—Oblon, Spivak, McClelland, Maier & Neustadt, P.C.

[57] ABSTRACT

An apparatus method of separating organic mass into its component parts in environmentally contained hygienic conditions at high thermal efficiency. One example is extraction of aromatic oils from citrus fruit. Organic materials derive from plants which contain (A) dry matter; (B) aqueous solutions and (C) secretions. The apparatus and method separates organic mass into these three components to create positive valuable products, frequently from negative value wastes. The apparatus and method utilizes a drying medium comprising a mixture of self derived superheated steam generated from part of the moisture given off by the material itself and air. The apparatus is fully enclosed, thus being environmentally benign and eliminating odors and deleterious emissions common to non-contained and/or direct fired dryers. Enclosure and use of superheated steam for drying, plus the combination of several processes in one operation, leads to higher thermal efficiency and lower operating costs than conventional drying or distillation processes.

14 Claims, 25 Drawing Sheets

METHOD AND APPARATUS FOR DRYING ORGANIC MATERIAL

BACKGROUND OF THE INVENTION

1. Field of the Invention

The invention relates to a method and apparatus for drying organic material. More particularly, but not exclusively, the invention relates to a method of extraction/distillation of aqueous solutions and secretions from organic mass and/or the drying of such organic mass and to apparatus for carrying out the same.

2. Discussion of the Background

Many materials used in commerce and industry derive from plants which grow in nature and contain many complex substances required by the plant to fulfil a wide range of functions.

Organic materials are used to produce many products for commerce and industry especially, but not exclusively, in the food and drink industries, and the processes used create by-products which comprise the residues of organic materials after certain fractions such as juice, pulp, seeds or skin have been used to make commercially desirable products from organic feedstock.

These residues are putrescible and they therefore present a significant waste disposal problem. They require disposal within a few hours or days of the initial processing operation and the products of decomposition may produce polluted leachate running into aquifers and noxious substances and odours emitted to atmosphere unless they are subject to disposal under careful and expensive conditions to prevent such pollutions of aquifers and atmosphere.

Plants also provide the feedstock for many bactericidal, fungicidal, cleaning, pharmaceutical, veterinary, flavours, perfumery and other consumer products as well as for the human food and drink and animal feed industries.

Where solid fractions are required for use as feedstocks in a process, these are normally obtained by drying which is a process in which moisture is driven off to atmosphere by the application of heat. This may or may not be subject to filtration of flue gases which are normally contaminated with evaporated liquids mixed with products of combustion of the fuel.

Where liquid fractions are required for use as feedstocks in a process, these are normally obtained by distillation which is a process in which moisture is driven off by the application of heat and is collected after condensation, with the solid residues normally being discarded as waste by-products. There is an opportunity to improve economy by combining the processes.

Desire to minimise damage to the global environment has led to a growing interest amongst peoples throughout the world in the possibilities of replacing synthetic substances, which are often derived from non-replaceable fossil fuel origins, with "natural" products. Such synthetic substances which can be of limited availability are being used up at a significantly fast rate.

All, or virtually all, plants secrete some oils or other liquids which are held in special oil glands, in sacs or in intercellular spaces of the plant tissue. These secreted substances are normally virtually insoluble in water and normally immiscible with water. They normally remain in the organic mass of plants when moisture is drained or driven off at low or medium temperatures. Many of these secreted substances have a high value for commercial usage.

During the life of the plant these secretions may be held or released for a variety of purposes. including, perhaps, such uses as attracting insects for pollination; repelling animal predators or dissuading parasites; repairing wounds; cooling by varnishing or vaporisation of oils; colouring; supplementing food reserves and many other such functions. These secretions are frequently oils in which case they may be known as essential, volatile or ethereal oils. If they are not oils, they may be alcohols, esters, ketones, aldehydes, terpenes, steroids, resins, latexes, rubbers, anthrocyanines, flavones and many other such substances. For the purposes of this application, all of the above will be referred to for convenience as essential oils. The common grouping derives from the combined qualities that they are largely insoluble with water and immiscible with water and that the plant secretes them away from its main tissue which contains large percentages of aqueous solutions or juices.

It is becoming more and more accepted in current commercial thinking that many of these secreted substances have importance to humans for a wide variety of commercial purposes.

Many new pharmaceutical and veterinary products are now and will be increasingly in the future derived from substances which are, themselves, derived from the secretions of plants as well as foods, drinks, flavours, perfumes and household goods for which they have been commonly used for centuries past.

Most of these secreted substances evaporate at temperatures of 150 to 300 degrees centigrade, well above the temperature at which water evaporates, namely 100 degrees centigrade. If however, these are evaporated in circumstances in which water and the secreted substances behave as a two phase liquid/two phase vapour, then the boiling point may drop to become lower than either of the constituents in their own right. Thus extraction of high boiling point substances is aided when a two phase liquid is evaporated from an organic mass. The issue to be resolved in such a circumstance is to remove the inaccessible secreted substances from the gland or sac in which they are held. Migration of such substances does not normally occur at the boiling temperature of water. For centuries past, distillation of secreted substances has required the application of superheated steam at temperatures capable of bursting the gland or sac which contains the secretion. The background to the invention includes the concept of bringing this past practice into the fields of waste recycling and animal food production.

Recently, there has been an unusually large increase in the cost of disposal of many organic wastes which are the by-products of manufacturing processes, most especially putrescible wastes that derive from organic feedstocks. The concept known as "The polluter must pay" has led, throughout the world, to a review of historic methods of disposal, principally "Landfilling", which involves placing waste into a hole in the ground. Political pressures everywhere are requiring higher standards of sealing landfill holes from aquifers and the atmosphere. This adds to expense.

Taxation is increasingly being used to direct commercial organisations down a recycling route instead of the landfilling route and many environmental groups actively promote recycling as desirable.

These circumstances have raised interest in new inventions which can make positive value products from what have been considered negative value costs of disposal. To achieve this any recycled products must be of marketable quality and fit for sale without fear of infections and contamination. One factor here is sterility and any process involving biodegradable substances and substances which may provide nutrients for organisms to grow must be put through a process which gives them sufficient time in the "Pathogen kill zone" of temperatures to ensure sterility of the finished product. A process which requires the feedstock to be subjected to many minutes at superheated steam temperatures in excess of that experienced in hospital autoclaves, for example, becomes particularly desirable when organic wastes are recycled.

The coincidence of increased interest in the beneficial properties of secreted substances from plants coupled with increased interest in cleaning the environment makes this an appropriate time to introduce an invention which contributes to both objectives in an integrated method and apparatus. Initial work carried out on citrus residues in order to produce marketable recycled products has a much wider application for obtaining both solid and liquid marketable quality products from either organic wastes or freshly cropped plants.

An example of the coincidence of demand for secreted substances and environmental pressure arises from the need to deal with the by-products of products which have been actively developed recently, namely freshly squeezed orange, grapefruit or lemon juice, produced in a factory and distributed through supermarket chains that same day. Having squeezed out the juice, the remainder of the fruit is normally discarded. After this, it is disposed of, either by tipping into landfills or by spreading on fields for animal consumption.

The first of these processes is becoming increasingly expensive, if pollution of aquifers and the atmosphere is to be avoided, and the second is now normally prohibited. The citrus residue decomposes rapidly, causing airborne smells and pollution of aquifers via road drainage during transport and via field drainage if it is spread in fields for animal consumption. The presence of the most common secreted substance in citrus residues, d-limonene, makes such waste relatively unpalatable to many ruminant animals which are conversely attracted to consume the dried material when the d-limonene is largely removed. The d-limonene however, is itself a valuable commercial product for flavour enhancement of food products and in many other uses.

SUMMARY OF THE INVENTION

If the citrus residue is processed when still fresh, therefore, using the method and apparatus of this invention, three benefits are derived:

(i) The solid output is made stable and, after removal of substances which make it unpalatable to animals, can be incorporated in mixed animal feed, especially cattle feed. By exposure of the material in process to many minutes at pathogen kill temperatures, it is made sterile.

(ii) The essential oils, of which terpenes, especially d-limonene, are the main constituent, are commercially valuable. In addition to terpenes, citrus residues contain valuable aldehydes (for example n-Octanal, n-Decanal and Citral), volatile alcohols and esters (such as n-Nonyl Alcohol and d-Linalool).

(iii) The aqueous condensate is commercially valuable as a source of demineralised water or it may contain a wide range of water soluble fractions which can be used as feedstock for the flavours, food and drinks industries, and in many other applications.

One object of the invention is to extract aromatic oils from citrus fruit. The term fruit is used to cover citrus fruit, citrus fruit pulp and citrus fruit peel. The term citrus covers such fruits as oranges, lemons, limes, grapefruit, tangerines and the like. This concept is now extended to extraction of many secretions (including aromatic oils) from organic mass (including citrus fruit).

Whilst a first application of the method and apparatus of the invention has been in the extraction of these aromatic oils from citrus residues as previously described, it has subsequently become clear that this method and apparatus has a very much wider application wherever organic materials are processed and wherever products are derived from the essential, volatile, ethereal and other oils and resins which are secreted in most plants.

The invention has a wider application, not only where there is a need to extract secreted substances from organic mass, but also for basic drying of organic by-products where the requirement is to remove enough moisture to stabilise an organic mass, such as slurry.

Several singular aspects of the present invention are well known. For example, essential volatile or ethereal oils and other secretions may be extracted from plant matter by distillation using superheated steam which has the ability to free the oils from the oil glands and sacs in the plant material.

It is also known that continuous enclosed processes may be controlled to give a virtual steady state condition wherein the mass of steam which is added to the stream in circulation, due to evaporation of feedstock, may be equalled by removing a similar amount of steam for condensation.

A substance may be dried by utilising the water evaporated from itself when such water is raised in temperature during recirculation to a level above its boiling point, viz "superheated", and then recirculated to evaporate more water.

When evaporating a two-phase mixture of oils and water based solutions which are immiscible, the boiling temperature for the two-phase liquid will usually be lower than the boiling point of either of them.

Furthermore, where relatively dense air is present in the same chamber as relatively light superheated steam which is less dense and not readily miscible, generally the light vapour will occupy the upper zones and dense gas will occupy the lower zones of a drying chamber.

Finally, organisms which thrive on organic nutrients may be killed by lengthy exposure to temperatures which are not high enough to introduce unacceptable taste changes to a food product and the term pasteurisation is commonly used to deal with one such method with the term pasteurisation units to calculate a combination of minutes times temperature sufficient to ensure that no or virtually no deleterious organisms remain to feed on the nutrients and multiply.

One object of the present invention is to combine the established principles of evaporation, distillation and/or drying, and a continuous enclosed process giving virtual steady state condition, providing full containment which entirely or substantially eliminates odours and/or other environmental nuisances by utilising a sealed continuously filled and emptied distillation and/or drying process which has no vents to atmosphere and which condenses all outflows.

Another object is to bring together the established principles of a continuously filled and emptied vessel giving virtual steady state conditions and drying a substance using superheated steam derived from moisture such that any individual particle or granule of the feedstock is not dried using superheated steam derived from itself, but derived from like particles previously exposed to superheated vapour which is re-heated and recirculated.

A further object is to combine the established principles of drying a substance using superheated steam derived from moisture originating from itself or its predecessors, with use of superheated steam to distil essential, volatile or ethereal oils; alkaloids; rubbers and latexes; anthocyanins and flavones and other generally water immiscible secretions, by releasing them from the glands and sacs which contain them in the originating plant mass.

Yet another object is to bring together the established principles of drying a substance using superheated steam derived from moisture originating in itself or from its predecessors with use of reduced temperatures due to the presence in a two-phase liquid of immiscible liquids and use this facility by circulating a mixed self derived vapour rather than pure steam.

Furthermore distillation and/or drying and vertical separation of light vapours and dense gases in a chamber to assist in separating secreted substances within an environmentally contained vessel may be assisted by adding controlled quantities of air into the self derived superheated steam.

Finally, it is an object of the invention to bring together the established principles of the use of self-derived superheated steam as a drying medium and the use of superheated steam to sterilise the material in process by killing pathogens and other organisms utilising nutrients in the mass.

Hence, overall, the central objective of the invention is to provide one apparatus in which separate products can be produced of marketable quality, whether produced from freshly grown and harvested feedstock or from feedstock comprising the by-products of food or waste process industries and to do this without emissions to atmosphere except for uncontaminated air.

The products derived from the invention may be any one or more of the following:

(i) Stabilised dry/almost dry solid materials usually suitable for animal feed or otherwise suitable for fertiliser. Dry material normally contains 10% to 20 wt. % moisture derived from feedstock at 60 to 80 wt. % moisture at which percentages the mass would be unstable and putrescent.

(ii) Stabilised liquids comprising the aqueous solutions inherent in plants from which organic feedstocks derive. These liquids have a commercial use as distilled water or as feedstock for consumer products.

(iii) Products of distillation originating from secreted substances inherent in the plant based organic mass. Such products include feedstocks for bactericidal, fungicidal, cleaning, pharmaceutical, veterinary, food, drink, flavours, flavour enhancement and perfumery produces.

Finally, by utilising a superheated stream comprising both steam and air, it avoids one of the problems of attempts to use self-derived steam alone with exclusion of air, which is the long time period needed to replace air with steam, during which time the product from such an apparatus is below standard and normally must be discarded.

According to a first aspect of the present invention there is provided apparatus for drying organic material, comprising a substantially sealed chamber, means sealingly to admit said organic material and a predetermined amount of air thereto, means sealingly to discharge dried organic material therefrom, heat exchanger means to recirculate gases within the chamber back to the chamber at a higher temperature, means to extract a proportion of the gases, being essentially steam, air and essential oils, from said chamber, means to condense said extracted gases and separate them into gaseous, aqueous and organic fractions.

Preferably the sealed chamber comprises a rotatable drum within a substantially sealed plenum chamber.

The means to admit said material may comprise a downwardly sloping chute or a screw conveyor.

The means to discharge dried material may comprise a hopper or screw conveyor.

Advantageously the sealed chamber includes a rotary drum with lifter plates, means to drive rotatably said drum at a speed which is so variable as to control the speed at which the organic material is transported through the system, means to duct air into a mount of the rotary drum and recirculate it via heater means, said heated moisture caused by drying said material being recirculated continuously via said heater means and said drum to cause further evaporation of moisture from the fruit.

Dried material may be ejected from the end of the drum into a hopper system in such a manner as to ensure air is allowed to enter the system only in predetermined quantities.

Superheated steam, air, particles, and essential oil vapours may be bled from the system via a duct into condenser means and there may be provided a separate distillation system wherein essential oils and aqueous solutions thereof are separated from gases, vapour or any particles retrieved from said condenser means in a liquid condensate form.

According to a second aspect of the invention, there is provided a method of drying organic materials comprising the steps of so feeding said organic material that only a predetermined amount of air is admitted therewith, heating the material by means of said air and steam generated by heating of the material, recirculating said air and steam to reheat it to a temperature in the region of 120–250° C., preferably 150–220° C., optimally 200° C., and readmit it to the organic material, so removing dried organic material that substantially none of the air, steam or any essential oils entrained therewith are removed therewith, removing a proportion of the air, steam and essential oil vapour, and condensing said removed proportion to separate it into its component parts.

According to a further aspect of the invention there is provided a method of extracting aromatic oils from citrus fruit, its pulp, or its peel, comprising passing the fruit into a substantial sealed processing means in such a manner that air is admitted at controlled rate; heating said fruit by means of a recirculating gaseous stream containing steam self-generated by evaporation of moisture from the fruit and heated by passing through heat exchanger means; so discharging dried fruit mass from said processing means that steam and air are retained within the drier; passing a portion of said gaseous stream including generated steam and air to condensing means, and separating the thus condensed steam into an essential oil fraction and an aqueous fraction.

Preferably the fruit is initially shredded or otherwise comminuted before being fed to the drying means. Advantageously the fruit has initially a moisture content in the region of 60 to 80 wt. %. The dried fruit mass exiting from the drier may have a moisture content of 10–20 wt. %, ideally in the region of 12 wt. %.

Citrus fruit, either whole or most usually in the form of pulp or peel is first comminuted in a shredder and then fed into a drying system via means to admit air at an appropriate rate into the system, set to avoid combustion or excessive oxidation of the aromatic oils, but sufficient to enhance the thermal capacity of the recirculating gaseous stream beyond the limited capacity achievable by self-generated steam arising from moisture released by the citrus fruit itself.

The processing system includes a rotary drum with lifter plates and can be rotatably driven at a speed which is variable to control the speed at which the fruit or peel is transported through the system. At start up, air is ducted into the mount of the rotary drum and recirculated via a battery of heater units. This heated air causes evaporation of moisture from the fruit, and the vapour moisture caused by drying is recirculated continuously via the heater units and passed through the drum. A large fan unit is turned at an appropriate speed to propel the air with the moisture which by now has been converted to superheated steam. The system then recirculates the superheated steam and air via chambers into the revolving drum. The drum is continuously fed with fruit or peel and the superheated steam continuously recirculates via the fan through the heat exchanger.

Dried peel is ejected from the end of the drum into a hopper system in such a manner as to ensure air is allowed to enter the fully sealed insulated container in which the rotary drum is operating only in controlled and moderated quantities sufficient for the process. Any emission resulting from the drying process are contained in the sealed container. Superheated steam and any other emissions are bled from the system via a duct into a condenser. This is cooled to condense the superheated vapour, gases, or any particles which are retrieved from the condenser means in a liquid condensate form. This condensate is treated in a separate system where oils and aqueous solutions from the citrus are removed and fed into separate storage tanks for sale or further use. The dried citrus pulp or peel is used as an additive in animal feed. The only emission to atmosphere is the air entrained in the process and subsequently released, which is totally inert. There are no noxious or deleterious emissions to atmosphere due to the totally enclosed nature of the apparatus.

BRIEF DESCRIPTION OF THE DRAWINGS

Embodiments of the present invention will now be more particularly described by way of example and with reference to the accompanying drawings, in which.

DESCRIPTION OF THE PREFERRED EMBODIMENTS

Figure 1:
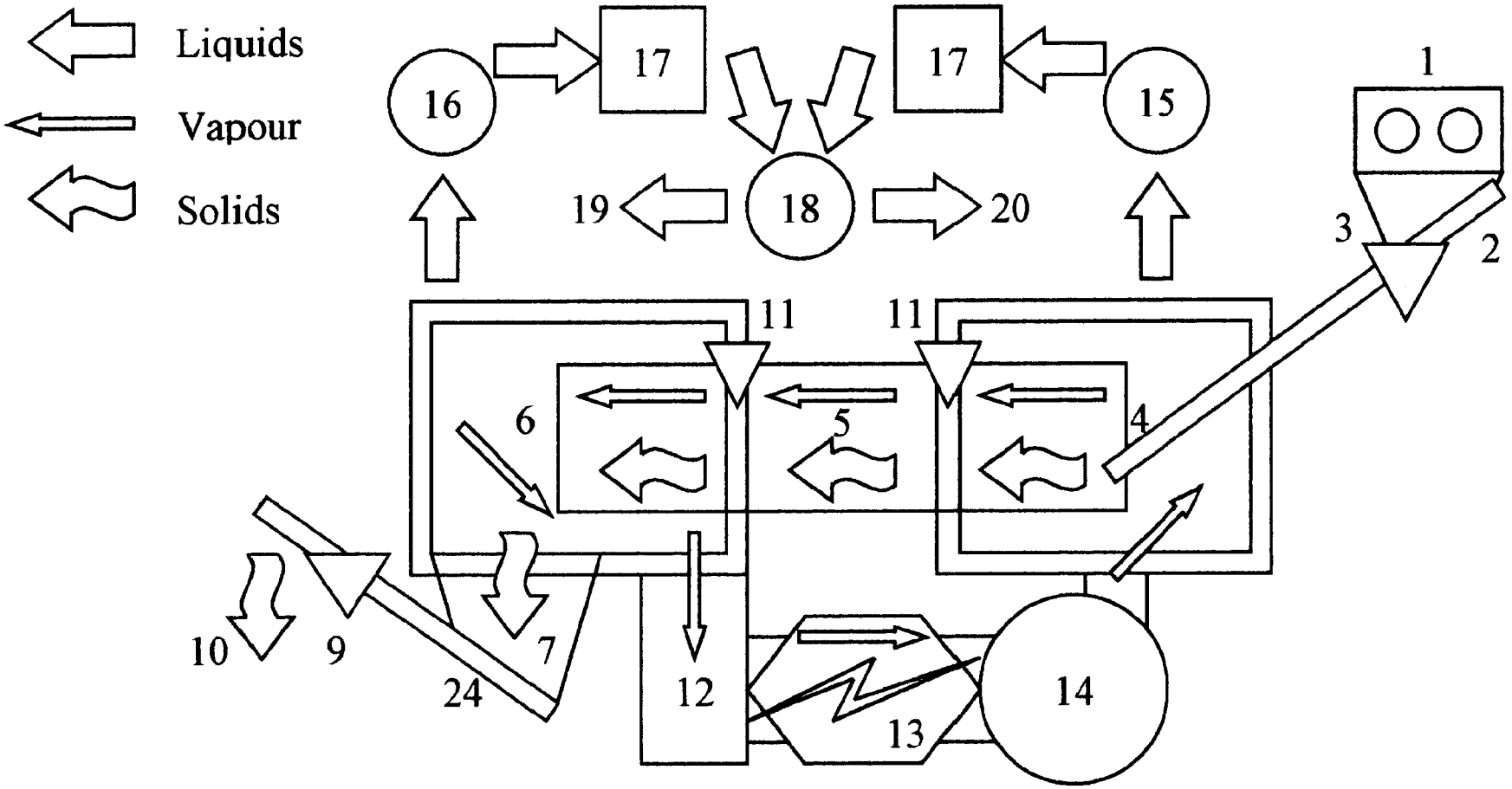
FIG. 1 shows an apparatus embodying the invention in schematic form and in a para-flow format.

Referring to the numbering in FIGS. 1. 2 and 3, the core elements are: Particulate Sizing Means 1; Feedstock Input Means 2; Steam Buffer Means 3; Hot Plenum Chamber Means 4; Transfer Chamber Means 5; Warm Plenum Chamber Means 6: Solid Fraction Collection Means 7; Solid Fraction Conveying Means 8; Steam Buffer Means 9; Dry Fraction Outlet 10; Steam Buffer Means 11; Superheat Collection Means 12; Heat Exchange Means 13; Air Pressure Raising Means (Fan Means) 14; Hot Vapour Extraction Means 15; Warm Vapour Extraction Means 16; Condensing Means 17; Secretions Separation Means 18; Water Soluble Fraction Outlet 19; Water Immiscible Fraction Outlet(s) 20.

The invention is directed towards, in combination, a number of elements namely:

An apparatus which is fully enclosed in which self generated superheated us used to extract secreted substances from organic feedstock that derives from plants or animals together with the water based moisture in the feedstock and subsequent condensation and separation of the various essential oils and solubles.

An apparatus to seal a moving segment of feedstock or dried product in a rotary drum within a fixed space by utilising a small differential air pressure and positive bleed of air into the superheated zone.

An apparatus to condense and separate secreted substances, such as essential oils, from a two-phase vapour/liquid of water based solutions and immiscible oils/chemicals varying with physical properties.

One raw material which may be processed by the method is citrus fruit pulp or peel, which is a waste product from the citrus fruit juice industry. Citrus fruits often contain in their peel a proportion of secreted substances known as aromatic or essential oils which give a characteristic odour to the fruit, accordingly, the method takes a waste product which is often difficult to dispose of and converts it into essential oils, which find utility as solvents and oil dispersants as well as flavourings or flavour enhancers, together with aqueous solutions which find utility as flavours and a dried residue which is sufficiently nutritional to be incorporated into animal feedstuffs.

Other raw materials include organic feedstocks, sewage, waste slurries and other vegetable wastes.

In general, the method also comprises, in combination, some or all of the following:

A method of extracting secreted substances comprising essential, volatile or ethereal oils, volatile alcohols, alkaloids, resins, latexes, rubbers, anthocyanins, flavones or other secreted substances stored by plants in glands or sacs or in intercellular cavities (herein referred to generally and for convenience only, as essential oils).

A method of drying organic feedstocks by removing moisture and secreted substances from the feedstock in a fully enclosed apparatus thus eliminating all or nearly all smells and other nuisances.

A method of drying organic feedstocks at above average thermal efficiency by recirculating heat and thus eliminating the largest part of any loss to atmosphere.

The process for all of the methods set out above follows the same principles to achieve different end objectives.

Feedstock is collected, stored and distributed via hoppers, conveyers and weighfeeders (1) using conventional materials handling techniques, which are not unique to the invention, in such a way that a reasonably even flow of feedstock is presented continuously to the apparatus at a predetermined flowrate.

Figure 2:
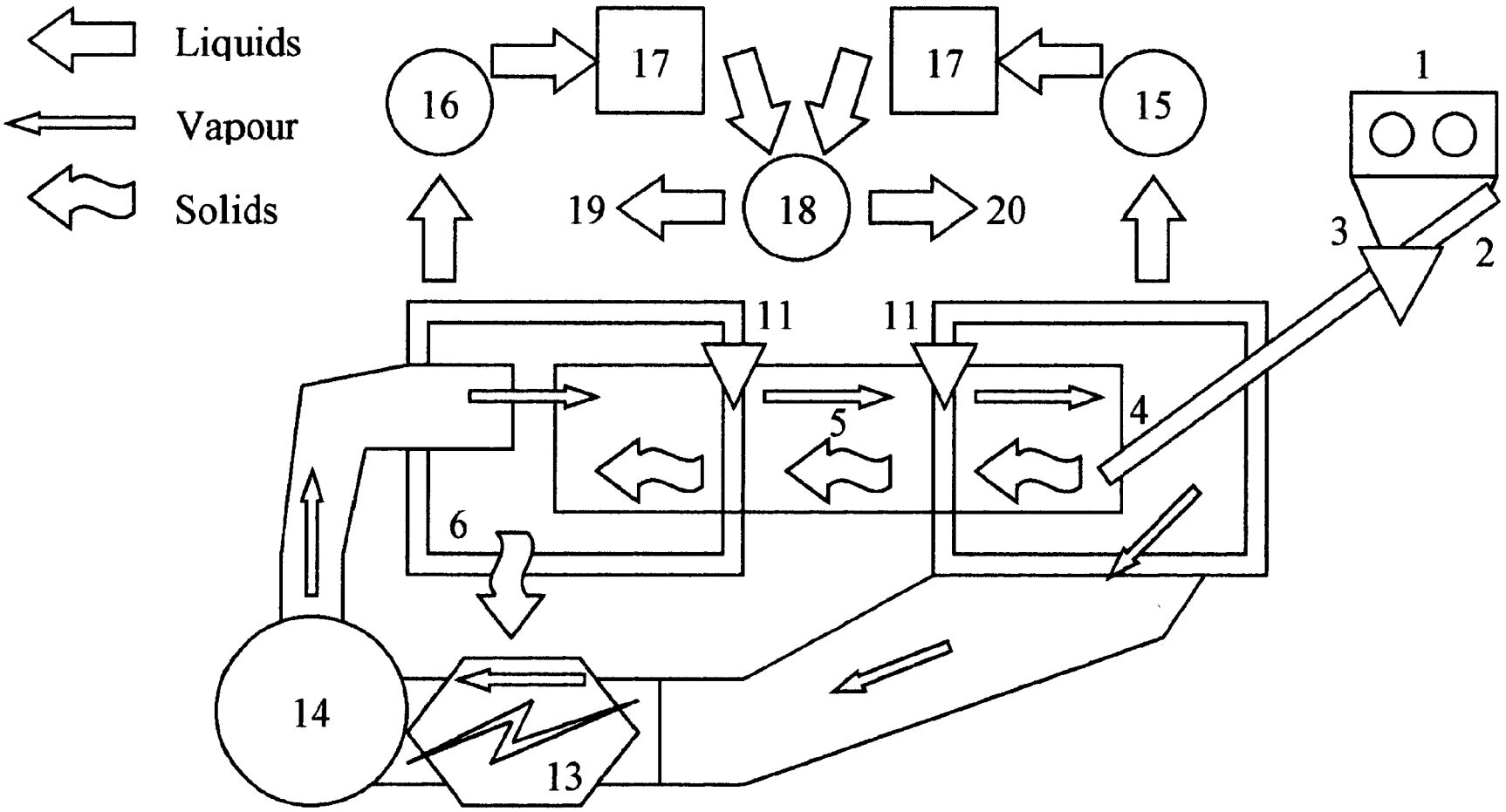
FIG. 2 shows the apparatus of the present invention schematically and in a contra-flow format.
Figure 3:
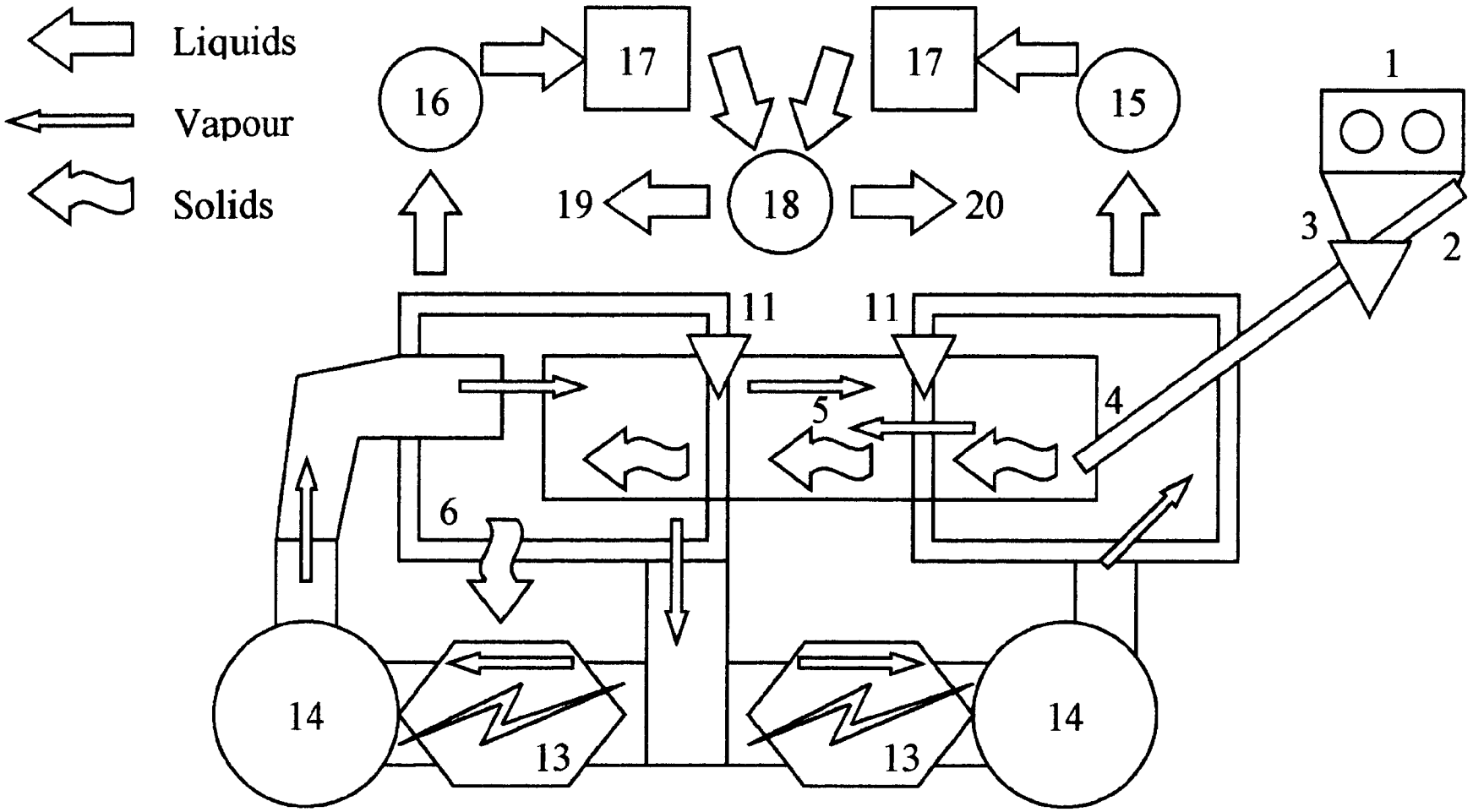
FIG. 3 shows the apparatus of the present invention schematically and in a combo-flow format.

Referring now to FIGS. 1 to 3, FIG. 1 shows the apparatus in paraflow format. FIG. 2 shows the apparatus in contraflow format, and FIG. 3 shows the apparatus in combiflow format.

In the case of FIG. 1, it would be possible to reverse the positions of the heat exchanger 13 and fan 14 without affecting the functions of the apparatus.

An advantage of this format is that the flow of the superheated vapour is in the same direction as the flow of product and movement through the transfer chamber is thereby assisted.

In the contraflow apparatus shown in FIG. 2, the feedstock enters the warm chamber 6 rather than the hot chamber of FIG. 1, and all of the vapour produced in the hot chamber 4 flows back through the transfer chamber 5 in a direction contrary to that in which the solids are moving, but the velocities are so arranged as to create better turbulence.

An advantage of this format is that the highest temperature of the incoming superheated vapour occurs at the point where the product is hottest and conversely, the cool incoming feedstock meets the lowest temperature of vapour. This may give improved thermal efficiency. The movement of the vapour being in opposition to the direction of movement of the product assists in obtaining a longer dwell time for the product in process.

FIG. 3 shows the combiflow format, which is a compound paraflow/contraflow system in which part of the vapour flow travels in parallel with the solids and part travels in a contrary direction.

An advantage of this format is that the two flows of highest temperature of superheated vapour are in opposite directions, thus leading to increased turbulence and a reduction in the effect of entrainment, by which feedstock is carried through the transfer chamber 5 at high speed aided by high velocity vapour.

It should be noted that in each of these formats, the apparatus may have combinations of either hot or warm extract devices and condensers or both, depending upon the physical characteristics of the secreted substances to be recovered.

The choice of format between paraflow, contraflow or combi-flow will depend on the physical properties of the feedstock to be processed and the length of the transfer chamber 5 in relation to the required residence time for treatment.

Figure 4:
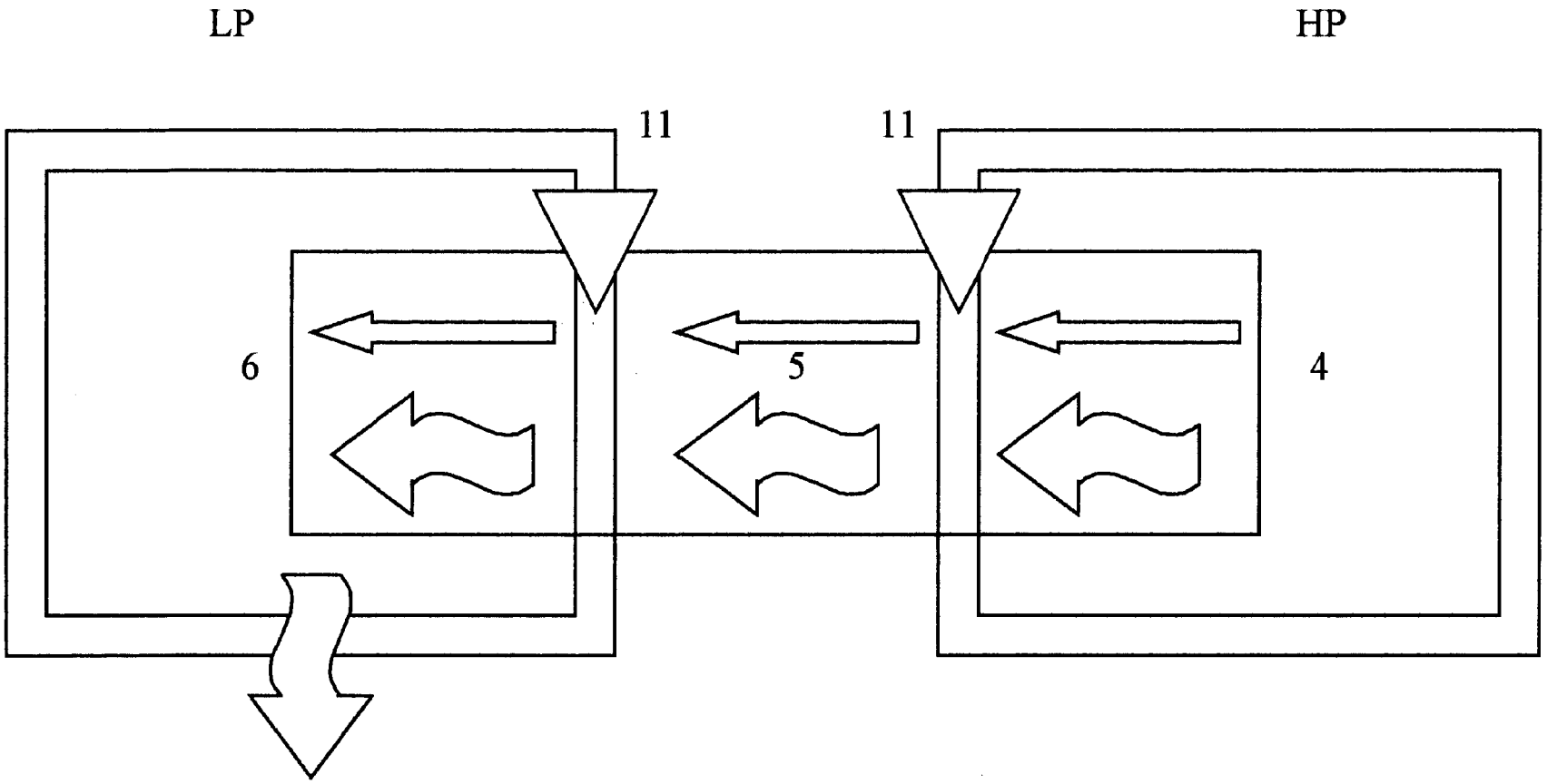
FIG. 4 shows a transfer chamber means and means associated therewith.
Figure 4A:
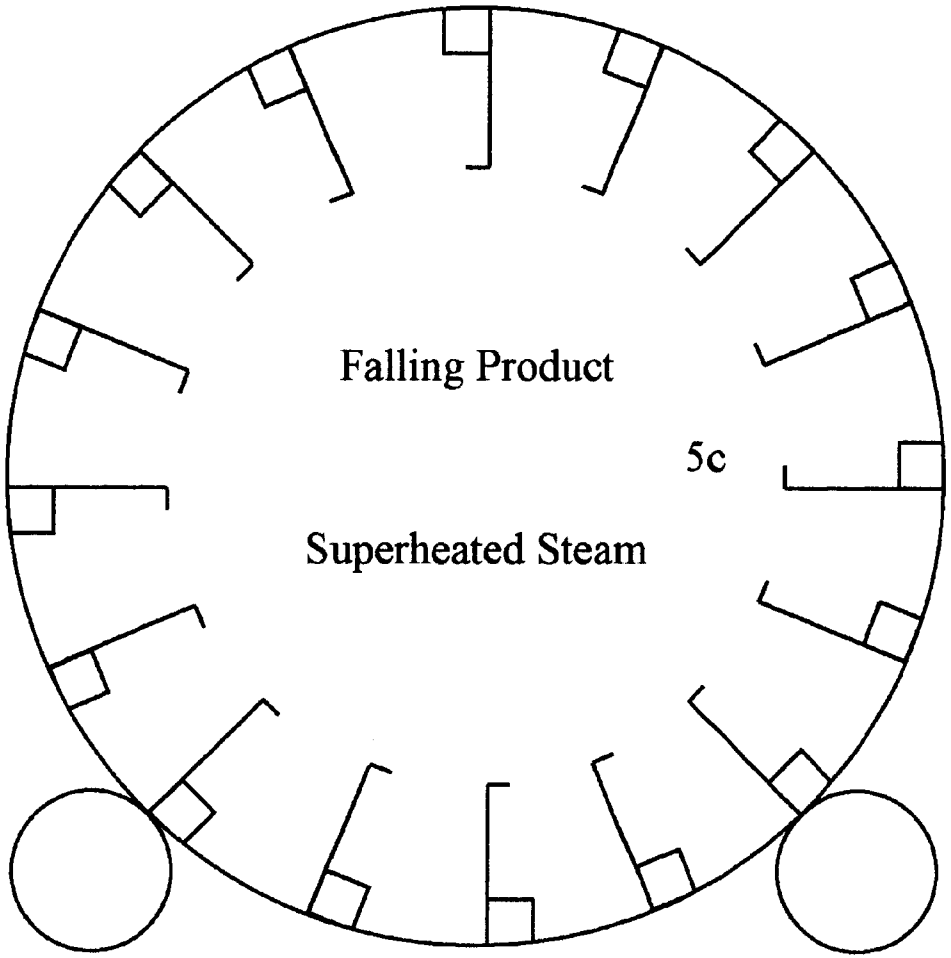
FIG. 4*a* shows the relationship of product to heating medium.
Figure 4B:
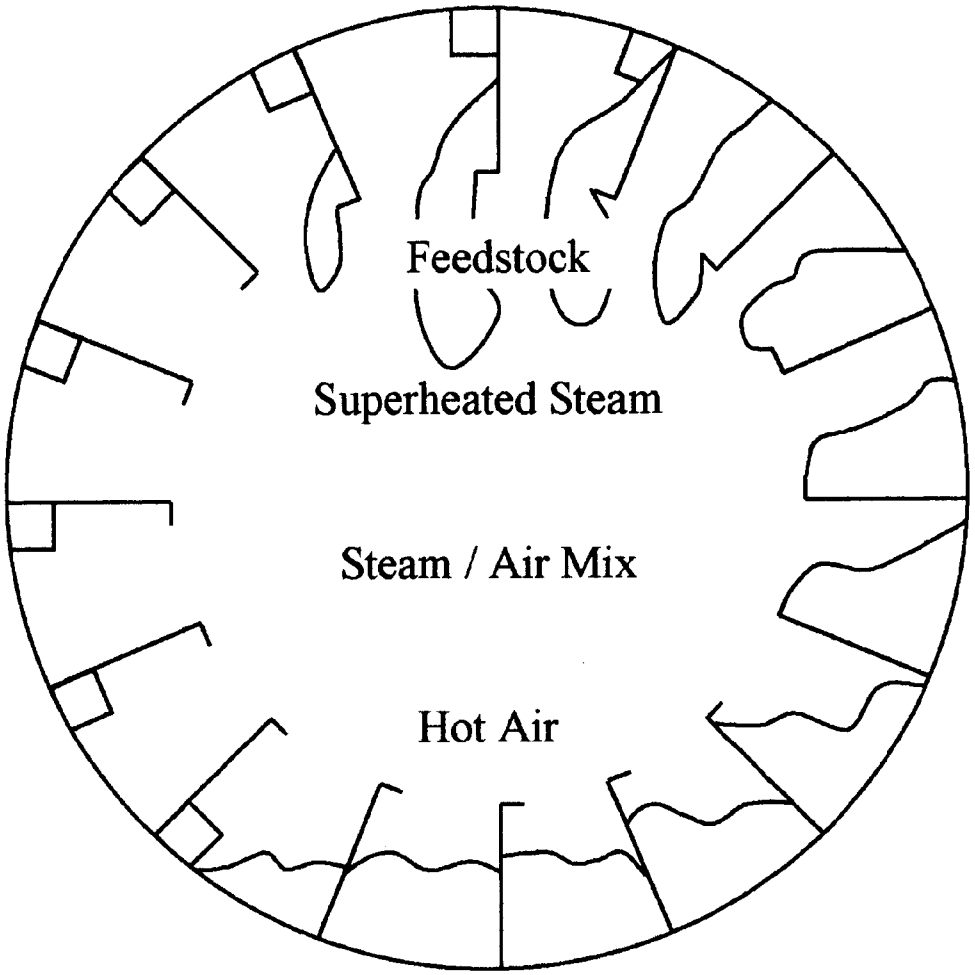
FIG. 4*b* shows the relationship of different elements of the heating medium.

Referring now to FIG. 4 relating to transfer chamber means, the apparatus is provided with a transfer chamber 5, a warm chamber 6, a superheat collector 12, a heat exchanger 13, an air pressure raising means (fan) 14 and a hot plenum chamber 4. The hot plenum chamber 4 is held at a significantly higher pressure than the pressure in the warm plenum chamber 6 so that any vapour in the hot chamber 5 flows by action of differential pressure through the transfer chamber 5 to the warm plenum chamber 6 giving up heat to the material in process as it flows.

The hot vapour must be substantially retained within the apparatus and this requires seals at points where there is access to ambient atmosphere. As well as an infeed seal 3 and a discharge seal 9, additional seals 11 are required at points where there is rotational movement between components. The feedstock may be reduced to a suitable particle size, adapted to provide good drying/distilling conditions by the particle sizer 1, and then transferred by the feedstock infeed device 2, passing through seal 3, which delivers feedstock in through the hot chamber 4 into an end of the transfer chamber 5. At this point it comes into contact with superheated vapour that is contained in the hot chamber 4. Having travelled through the transfer chamber 5, the dry element of the feedstock becomes first material in process and then dried end product. The dried end product passes from the transfer chamber 5, through the warm chamber 6 where it is separated from vapour and liquids, and is then passed via collection hopper 7 to the discharge device 8 and seal 9.

Figure 5:
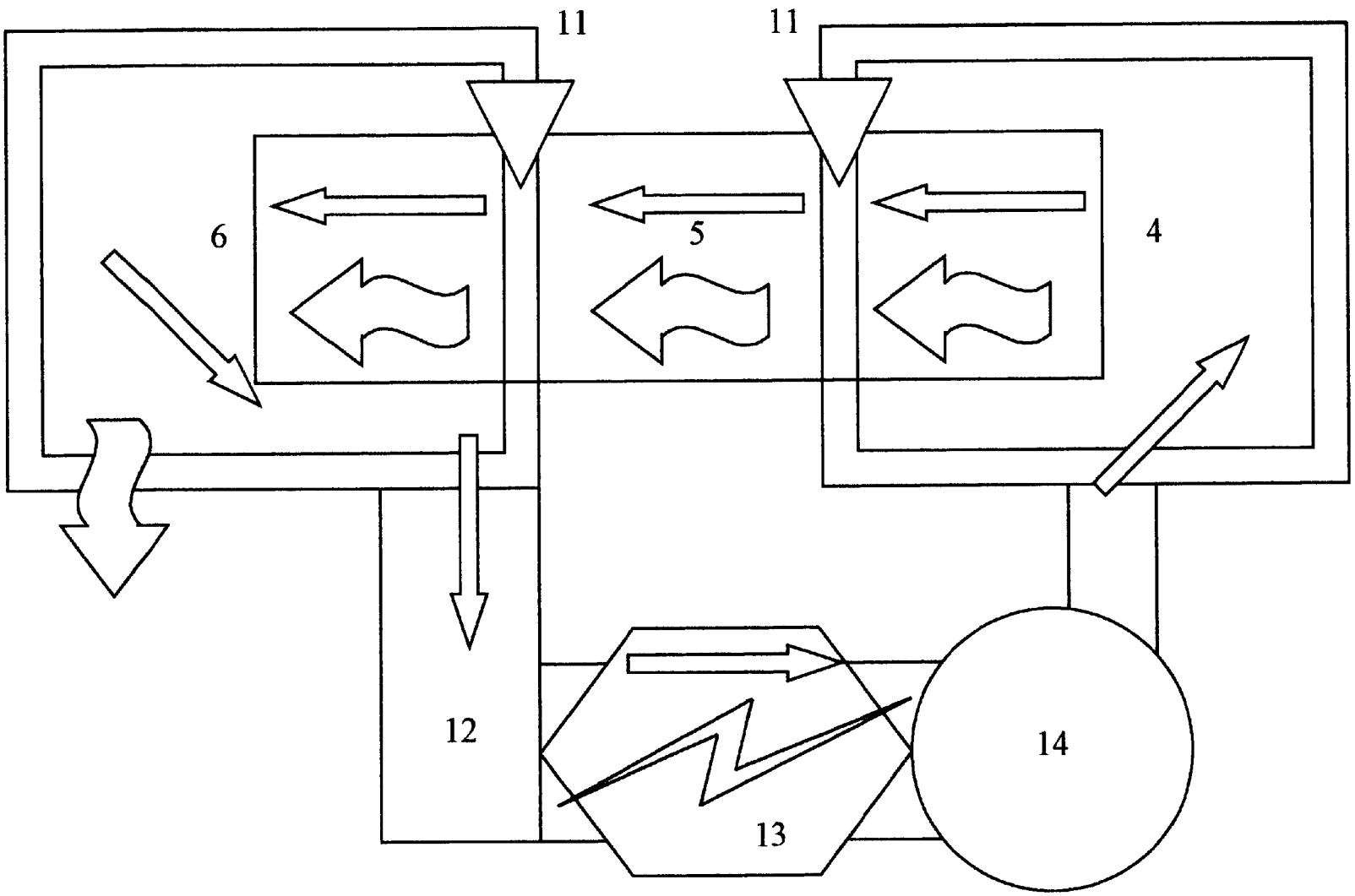
FIG. 5 shows heat exchange and means associated therewith.
Figure 5A:
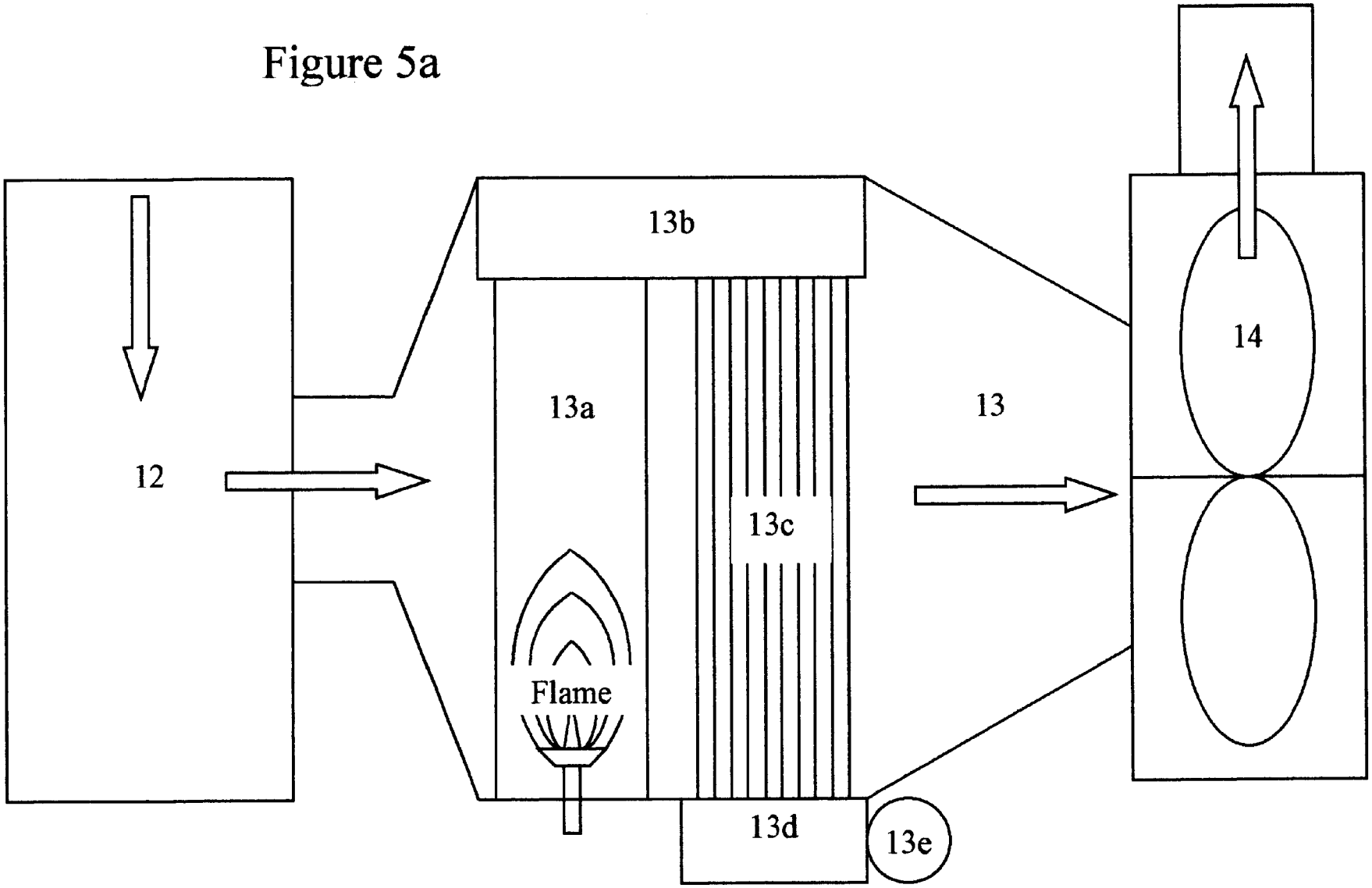
FIG. 5*a* shows in more detail, the heat exchange and means associated therewith.

FIG. 5 shows the heat exchange means. In this, a two-phase liquid, being mainly water, is evaporated in the transfer vessel to produce steam which is drawn through a warm chamber 6 via superheat collecting means 12 to heat exchange means 13 where sufficient heat is provided through a heat exchanger from a fuel source to raise the temperature of the vapour so that it is now hot enough to be used itself to evaporate more of the two-phase liquid and thus perpetuate the process. From the heat exchange means 13, the superheated vapour passes through a fan 14, where its pressure is increased sufficiently so that it may enter a hot plenum chamber 4 which is held at a higher pressure than chambers 5 and 6. The newly superheated vapour joins the mass of other vapour in the hot chamber and flows as at the start of this description. Thus the heat from the heat exchanger in the heating chamber is transferred to the material under process in the transfer chamber to have the dual effects of drying and distillation.

The vapour has not contact with the products of combustion. The heat exchange at 13 is so arranged that any lame is generated in the enclosed fire tube 13*a* and the products of combustion travel via a manifold 13*b* to multiple return tubes 13*c* and via a collection header 13*d* to a flue 13*e*.

Figure 6:
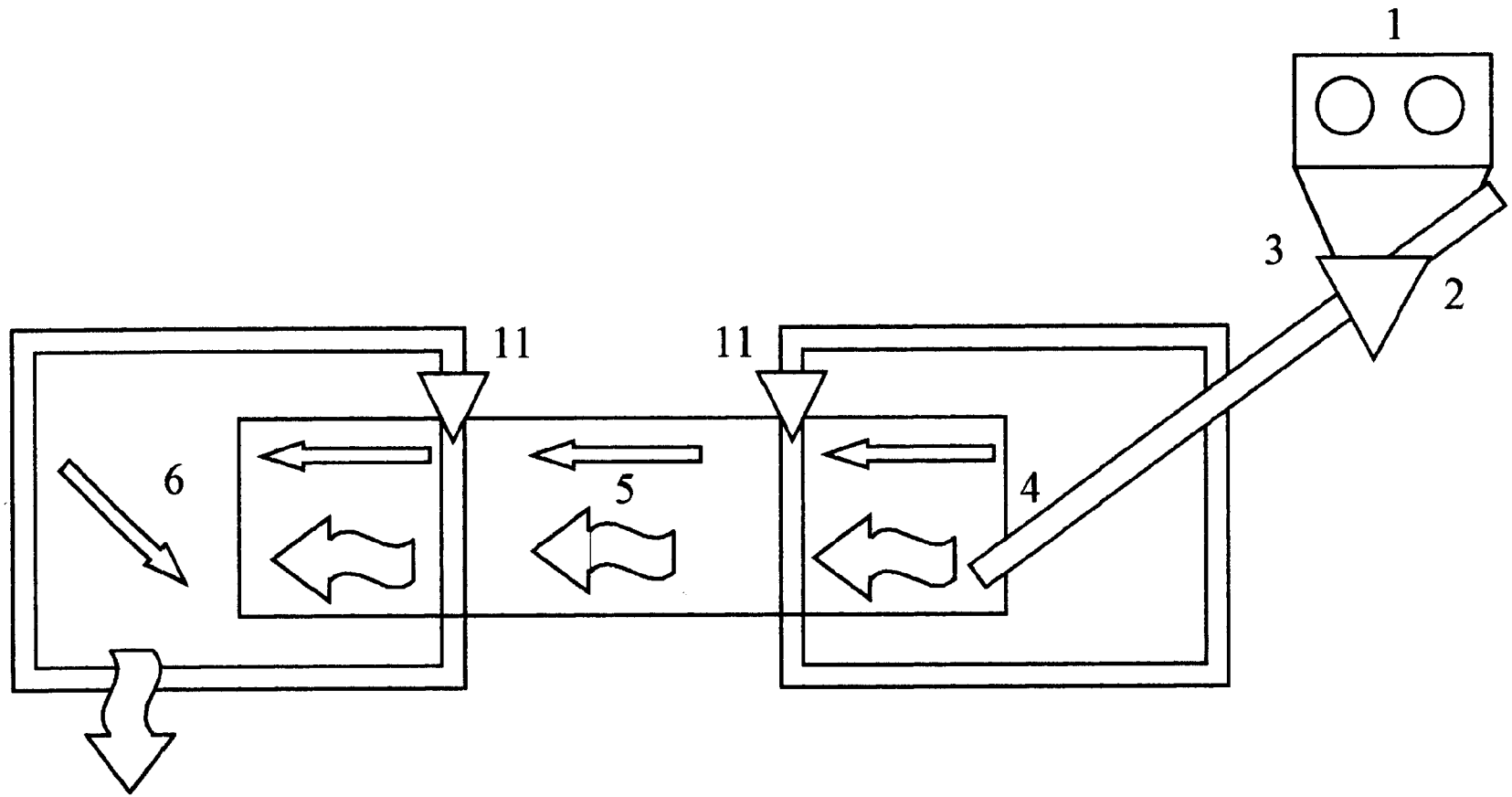
FIG. 6 shows a feedstock input means, and means associated therewith.
Figure 6A:
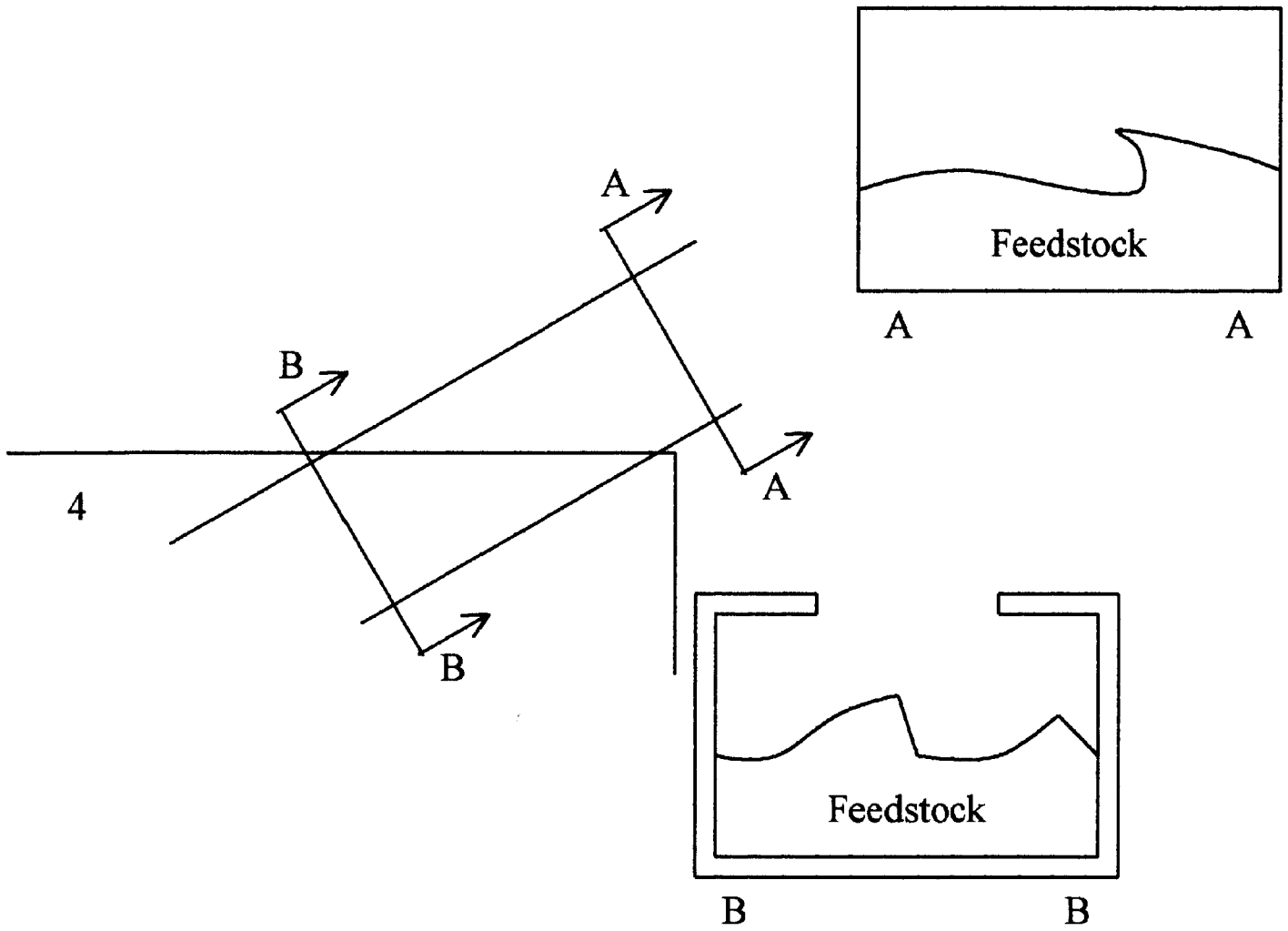
FIG. 6*a* shows different cross sections inside and outside the enclosure.

FIG. 6 shows the feedstock input means. The method relating to the feedstock input requires ancillary elements which support the core elements commences with a particulate sizing means 1 which reduces the size of component parts of the feedstock to a predetermined range of sizes. This means may be a comminuter, shredder; chopper; chipper; mincer; grinder; granulater, slicer or other such means. Where seeds or other organic material having a small and discrete structure are the feedstock, no particulate comminuting means may be required. Such means may or may not have a screen to eliminate or recirculate oversize particles. The size of particle needs to be determined for each type of organic feedstock on the basis that larger particles require longer for superheated steam/air mixture to enter the particle, leach the oils from the oil glands or sacs and for that oil to find its way to the surface of the particle where it is able to evaporate. Smaller particles will be more prone to entrainment leading to them being blown rapidly through the transfer vessel thus giving shortened residence time.

From the particulate sizing device 1, the feedstock is moved by a feedstock input 2 capable of depositing the feedstock into the transfer chamber 5 in which the main separation of the feedstock's components will take place. The feedstock input means carries the feedstock through a hot plenum chamber 4 which contains a moving mass of superheated vapour en route from the heat exchange 13 via the fan 14 to the transfer chamber 5. Depending upon the detailed design of the feedstock input, there may or may not be contact between the feedstock and superheated steam in the hot plenum chamber 4, but normally there would be such contact. It is desirable that the feedstock input slopes downwards into the transfer chamber at a steep angle which is greater than the angle of repose of the feedstock on a flat surface, because the feedstock will bake onto any surface on which it rests without sliding at the very elevated operating temperatures experienced in the hot plenum chamber 4, if any part of the device is not fully draining all feedstock at all times. Since the feedstock input 2 must have an open end at time of delivery of feedstock into the transfer chamber 5, it is necessary to prevent steam venting through the feedstock input device to atmosphere in order to maintain the full containment of the steamy vapours.

An advantageous arrangement of the inlet chute is shown in FIG. 6. Cross-section of the infeed chute 2 changes from an enclosed box, necessary to seal the system to become an open top trough within the enclosed part of the system, which allows the feedstock to come into contact with the superheated vapour gradually before it arrives in the transfer chamber means 5.

Figure 7:
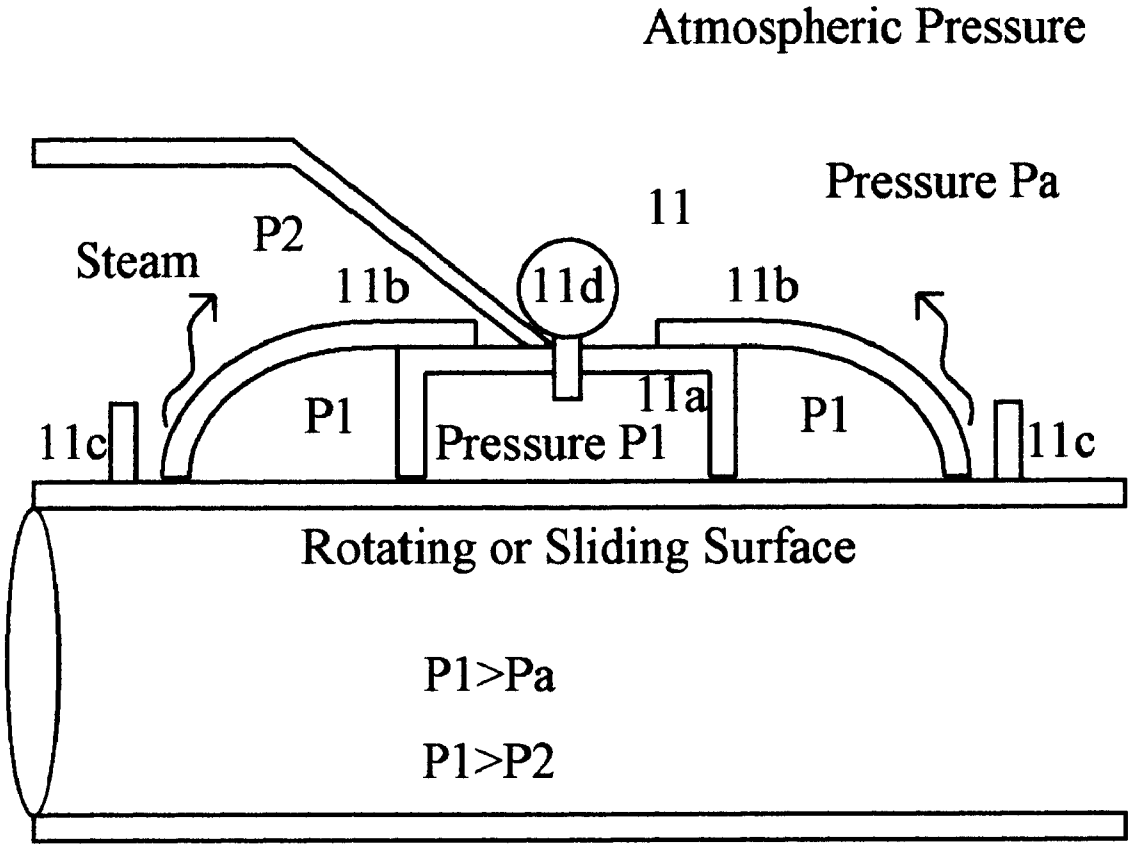
FIG. 7 shows one embodiment of a steam buffer means involving an air curtain.
Figure 8:
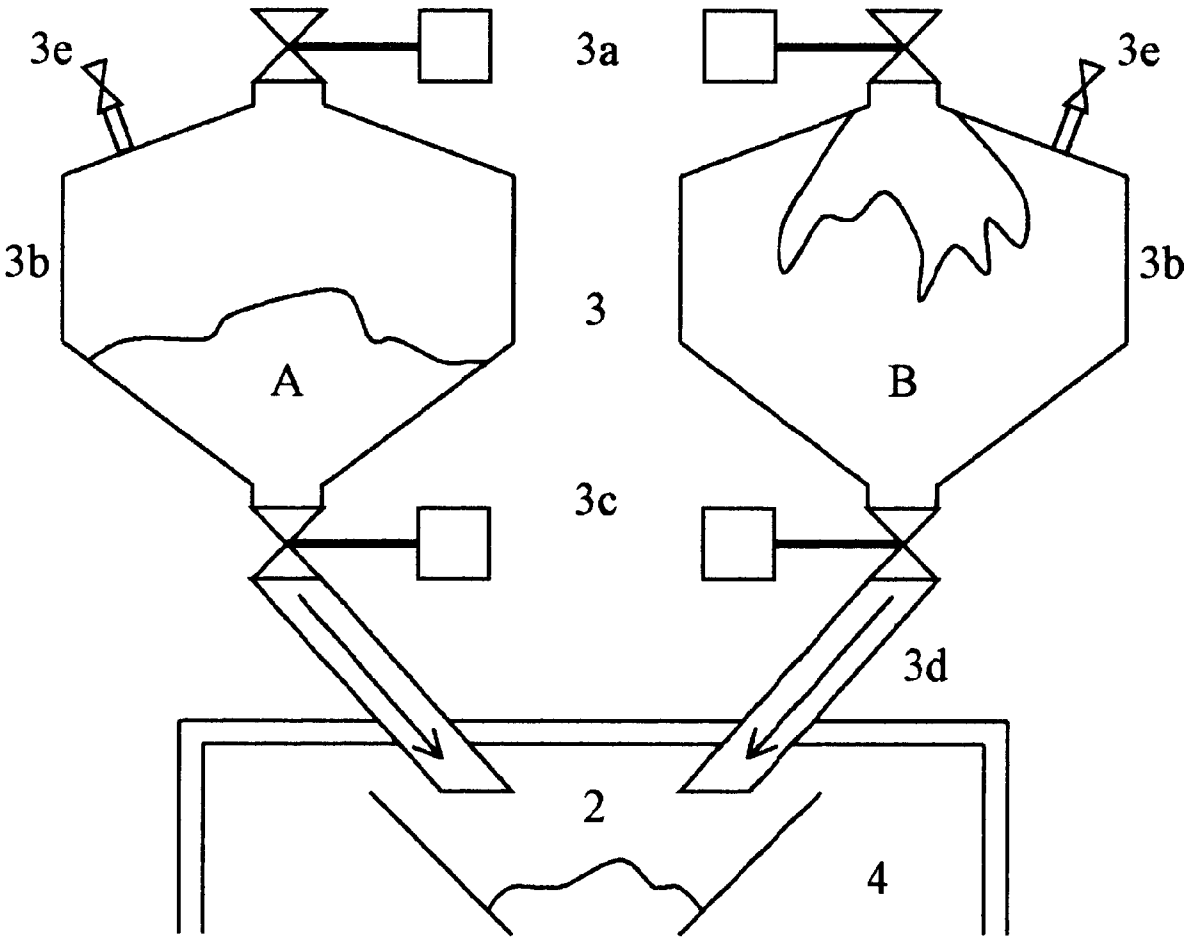
FIG. 8 shows a second embodiment of the steam buffer means including a double alternating hopper input means.
Figure 9:
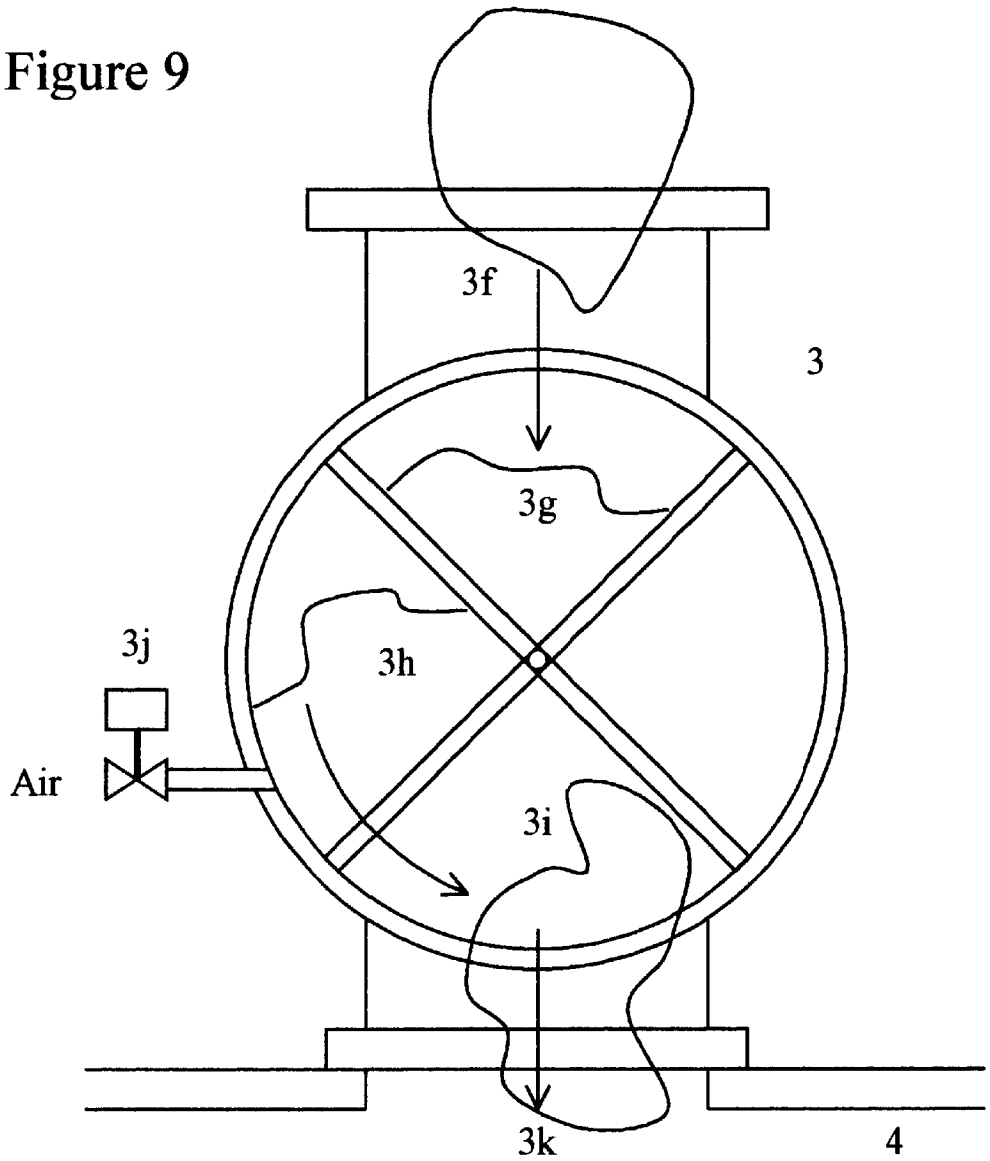
FIG. 9 shows a third embodiment of steam buffer means including a pressurised rotary valve.

Three alternative steam buffer means for locations 3, 9 and 11 may be used and are shown in FIGS. 7, 8 and 9.

FIG. 7 shows means to contain the steam in the system in which one part moving relative to another, such as a rotating drum or a reciprocating shuttle, can maintain a substantially sealed system by means of a single air curtain. It is known to provide two or more air curtains in a single device to achieve this object but these generally require an air flow that has sufficient velocity to distribute the gas or air to a predetermined pattern. A single air curtain requires less air velocity and thus less flow, which is advantageous in controlling the amount of air in the system.

In FIG. 7 an air curtain 3*a* is supplied by a fan, air pump or compressor at a small pressure differential above the pressure of the steam in the hot plenum chamber 4 and at a flowrate somewhat greater than the losses due to leakage from the feedstock input 2 and thus provides a very simple, hygienic and reliable device for preventing superheated steam escaping to the atmosphere. Because the pretransfen the feedstock input 2 is always greater than that in the transfer chamber 5 and hot plenum chamber 4 and since the flowrate exceeds the losses from the device, then the flow should always comprise a small flow of air into the main body of the apparatus and not a flow of steam past the air curtain 3*a* into the environment via the open feedstock infeed 2.

Air or an inert gas is supplied through to a curtain chamber 11*a* which surrounds completely the opening to be protected, which is held at a pressure P1, which is higher than the pressure in the chamber to be protected the pressure of which is denoted by P2. Between the chamber at P1 11*a* and the chamber to be protected at pressure P2, there is provided a semi-flexible curtain 11*b* shaped to fill partially the gap to be protected. On any moving surface which may rotate or slide, there is provided a fixed upstand 11*c* which serves to limit the movement of the curtain 11*d*. This arrangement allows air which is in the chamber 11*a* to leak at a steady but limited rate into the chamber to be protected. As pressure P1 is always higher than pressure P2, none of the superheated steam at pressure P2 can escape from a low pressure zone to a higher pressure zone. At the other side of the device, a similar flexible curtain 11*b* an upstand 11*c* allows air to escape to atmosphere and thus keep the chamber 11*a* in a steady state. A header 11*d* is provided advantageously to bring the supply of air to a plurality of positions along or around the chamber 11*a*.

In FIG. 8 two feedstock infeed hoppers 3*b* are used. These hoppers have air operated slides at the top inlet 3*a* and bottom outlet 3*c*. These slides are interlinked so that the top slide 3*a* of one hopper (hopper "A") is open when its own (hopper "A") bottom valve 3*c* is closed. During this filling cycle, hopper "A"is slightly pressurised with air such that the pressure exceeds that in the hot plenum chamber means 4. During this cycle the bottom slide 3*c* of the other hopper (hopper "B") is open and the top slide 3*a* of hopper "B" is closed. When the emptying hopper (hopper "B") has fully discharged and detected as being empty the air flow is transferred from hopper "A" to hopper "B" and the position of all four slides reverse. Hopper "A" is emptied. whilst hopper "B" is recharged. By this means, no steam can pass from the hot plenum chamber means 4 or the transfer chamber means 5 to the atmosphere.

FIG. 9 is a third alternative and shows use of a pressurised rotary valve 3*e* with four or more chambers and this is most suitable when the feedstock is in discrete particles that do not bond together under pressure, for example seeds. Each chamber of the rotary valves is given a slight positive pressure before it turns into the discharge position and no steam emits.

Figure 10:
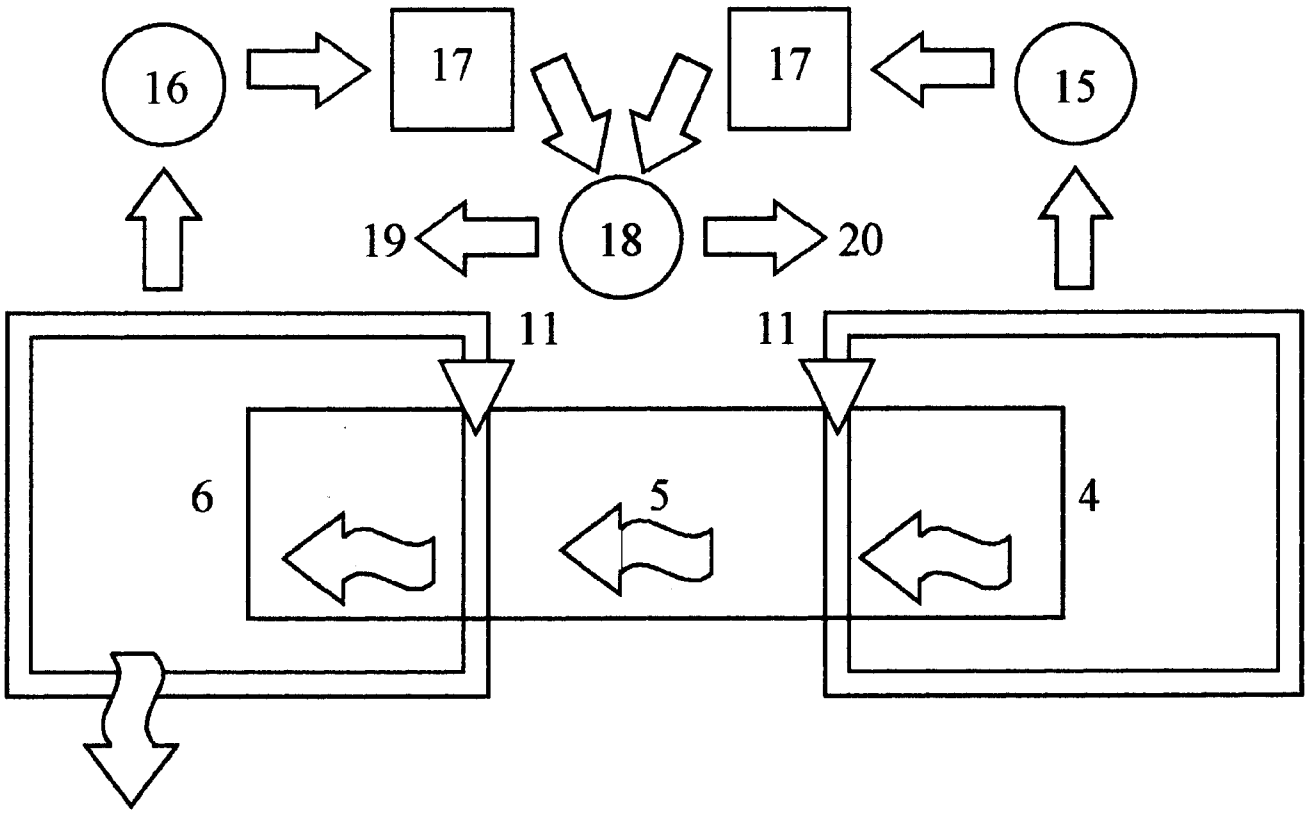
FIG. 10 shows schematically a drying and distillation means.
Figure 10A:
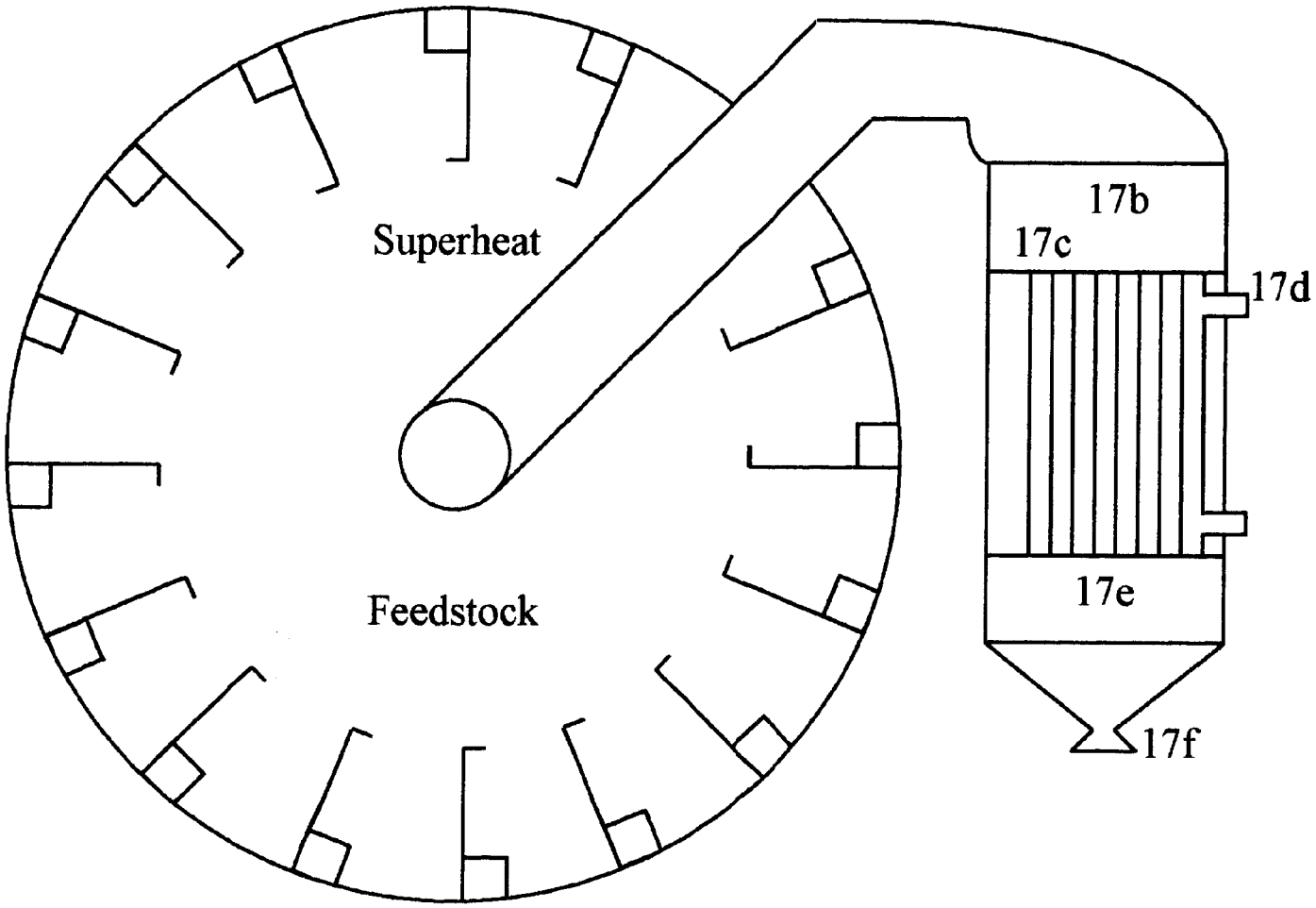
FIG. 10*a* shows the apparatus in combination with a traditional still.

FIG. 10 shows drying/distillation apparatus. The feedstock is deposited in the transfer chamber 5 in a continuous flow at which point it comes into contact with the superheated steam which flows from the hot plenum chamber 4 via the transfer chamber 5 to the warm plenum chamber 6. The superheated steam coming into contact with any particle of organic material in the transfer chamber 5 starts a number of processes.

The temperature differential between the superheated steam and the organic particle is sufficient to begin to heat up the particle and to cool down the surrounding superheated steam so that eventually they would achieve a common equilibrium temperature if sufficient time was available. The residence time would rarely be sufficient for equilibrium to be achieved in a continuous plant. At the same time as the particle is being heated up the steam intrudes into the structure of the organic material bursting the oil glands and sacs that contain secretions and releases them to escape into the particle. Furthermore, a void exists in a steam bubble and the opportunity occurs for the essential oils or other secretions to occupy that void and be conveyed more rapidly out of the particle. Meanwhile the water and water soluble substances and the newly released secreted substances all tend to migrate under the influence of increasing heat from the inside of the particle to its surface where they become available for evaporation. As evaporation is taking place it draws out the moisture from the interior of the particle including the secretions as well as water and the water based solutions which are present and represent the main body of the moisture. As the steam immediately surrounding the particle takes up water, water solubles and secreted oils, etcetera, it becomes wetter and would cease to be as effective as a result if it stayed in contact. The method dictates that greater efficiency is obtained if the particle is continually moving and is able to expose as much surface area as possible to freshly arriving dry superheated steam which is achieved in the apparatus.

Figure 11:
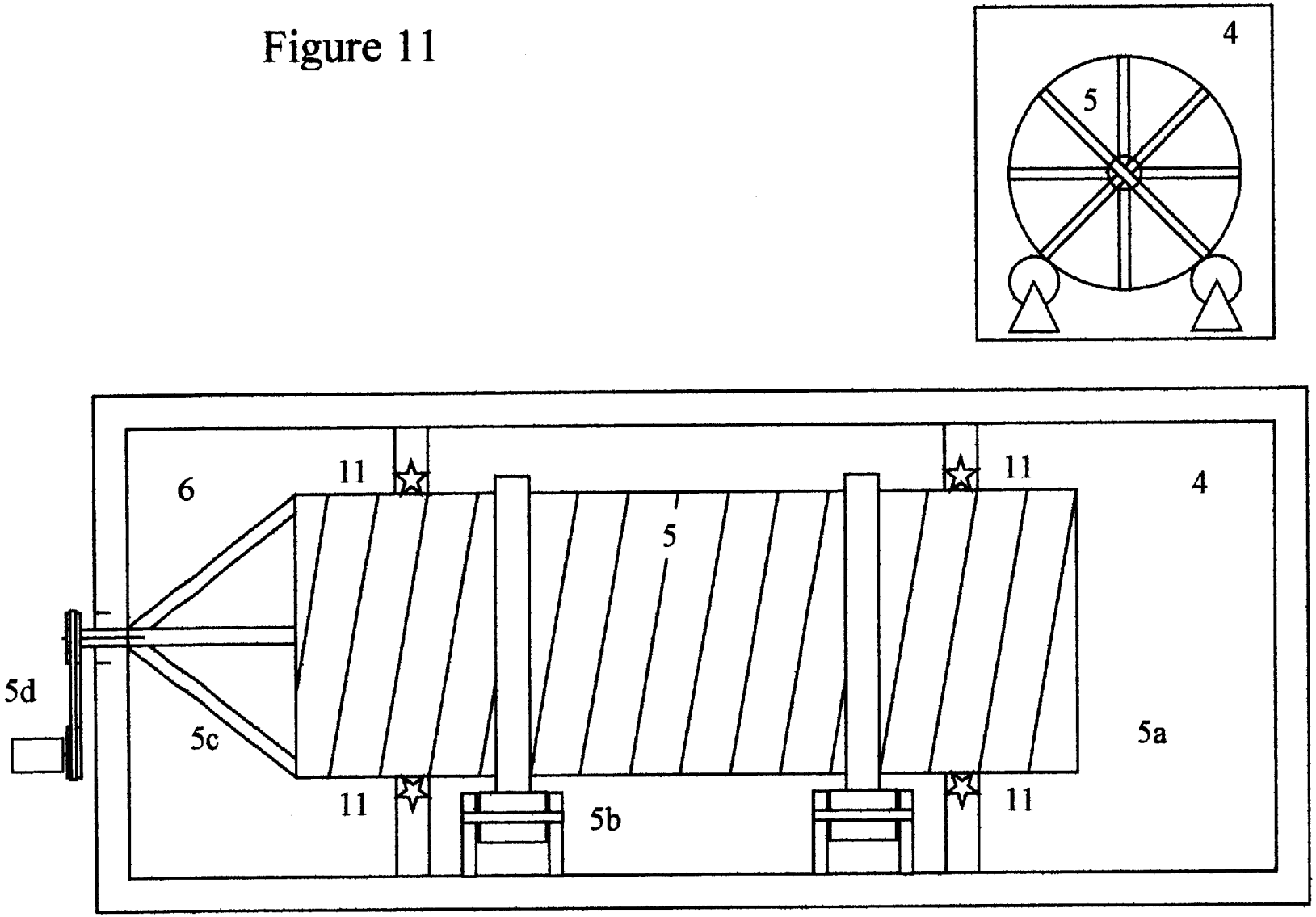
FIG. 11 shows in elevation and cross section a transfer device in the form of a rotary drum with lifting flights.
Figure 11A:
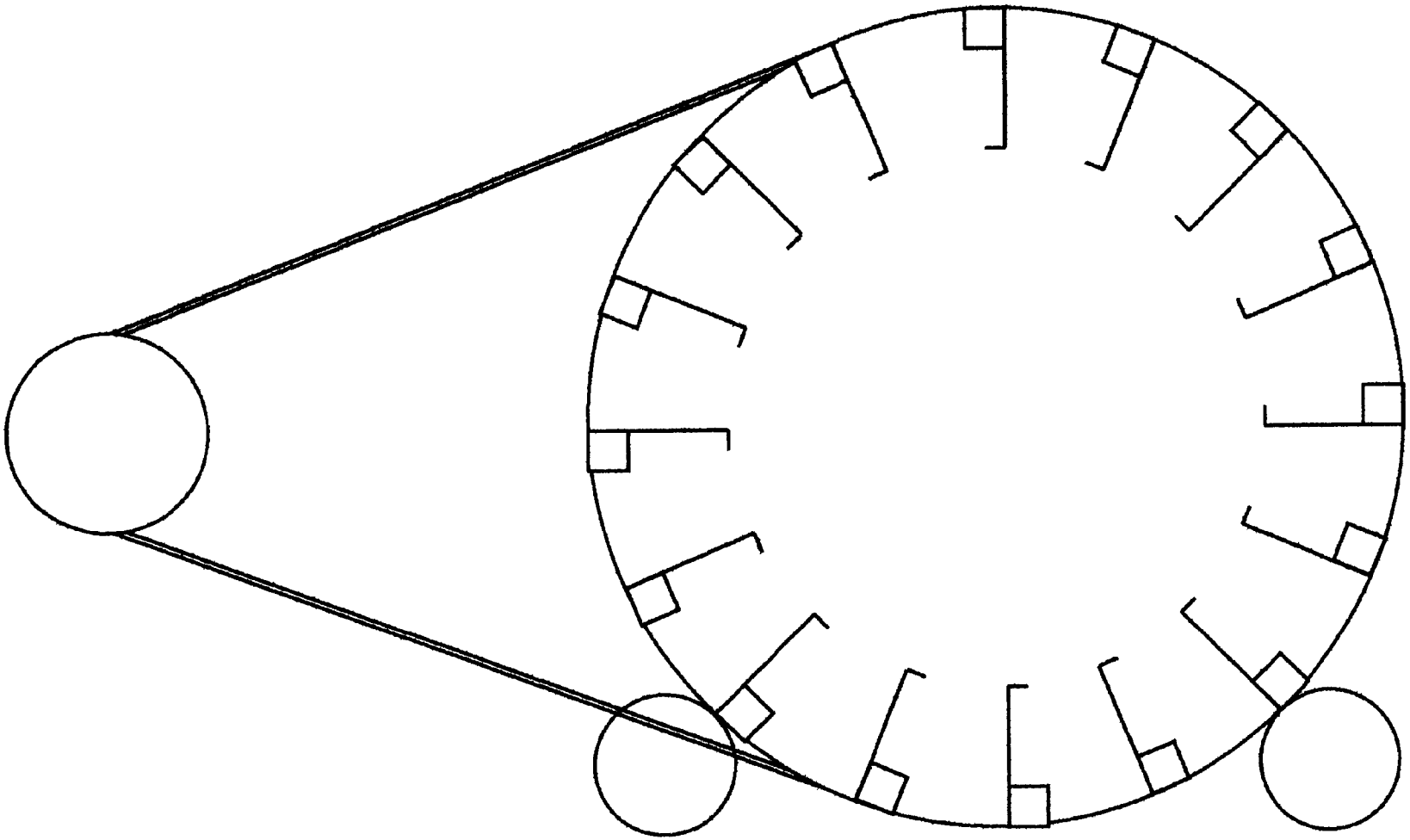
FIG. 11*a* shows an alternative drive arrangement of drive by chain.
Figure 11B:
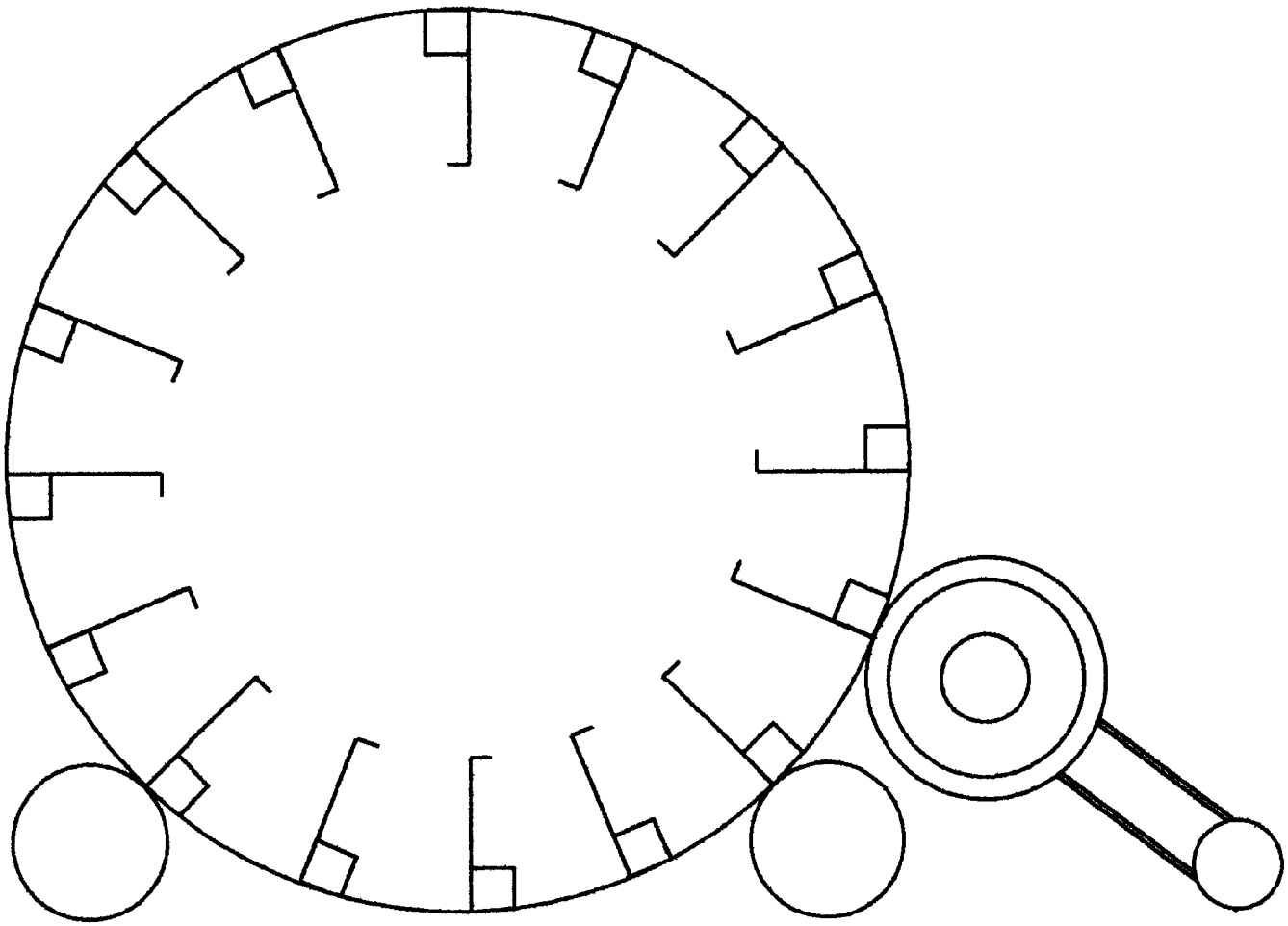
FIG. 11*b* shows an alternative drive arrangement by friction.
Figure 11C:
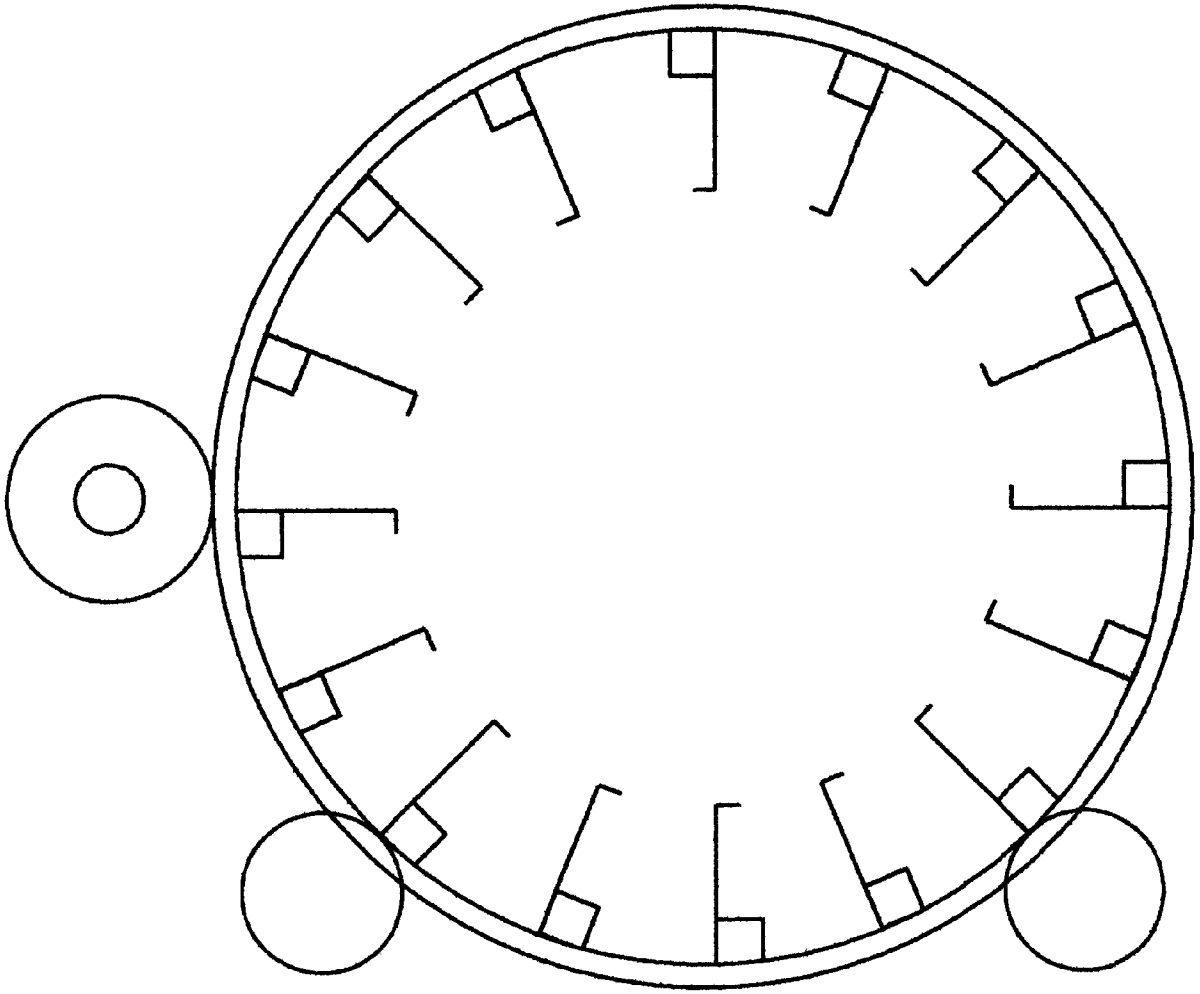
FIG. 11*c* shows an alternative drive arrangement by gears.
Figure 11D:
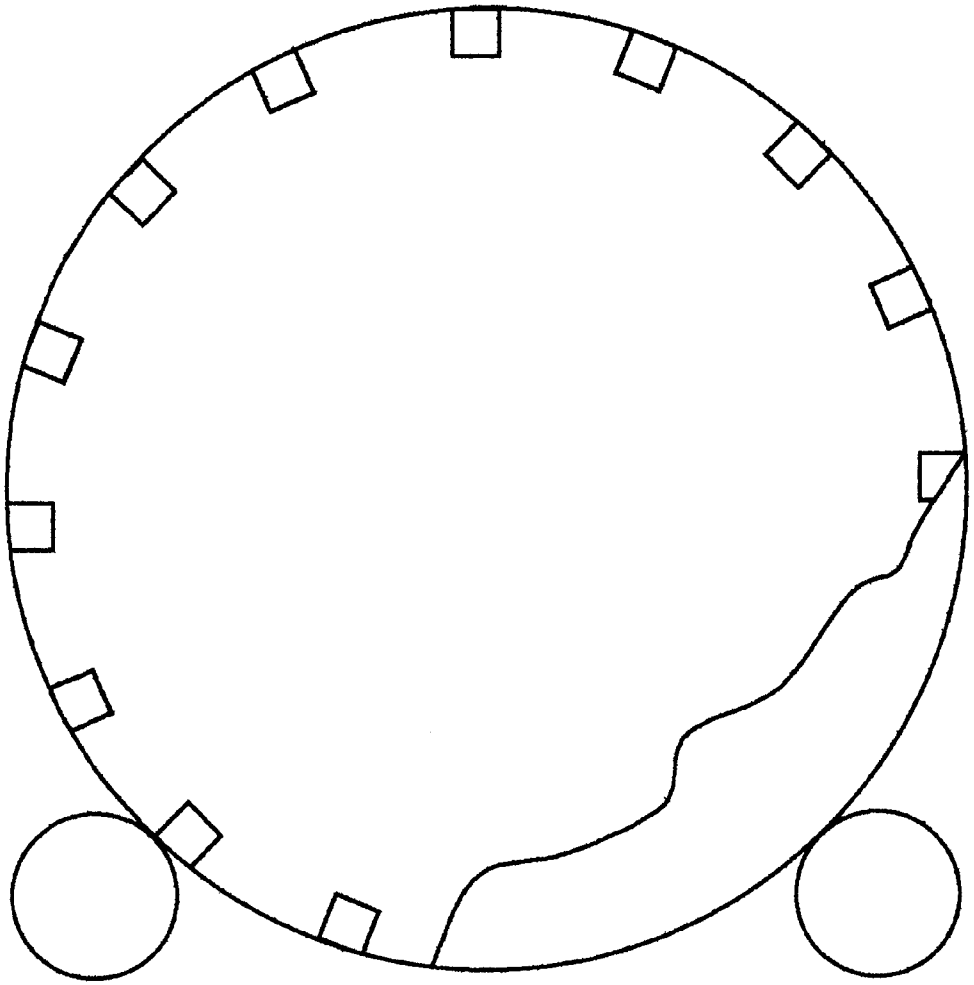
FIG. 11*d* shows an the annular flow within the transfer chamber.
Figure 12:
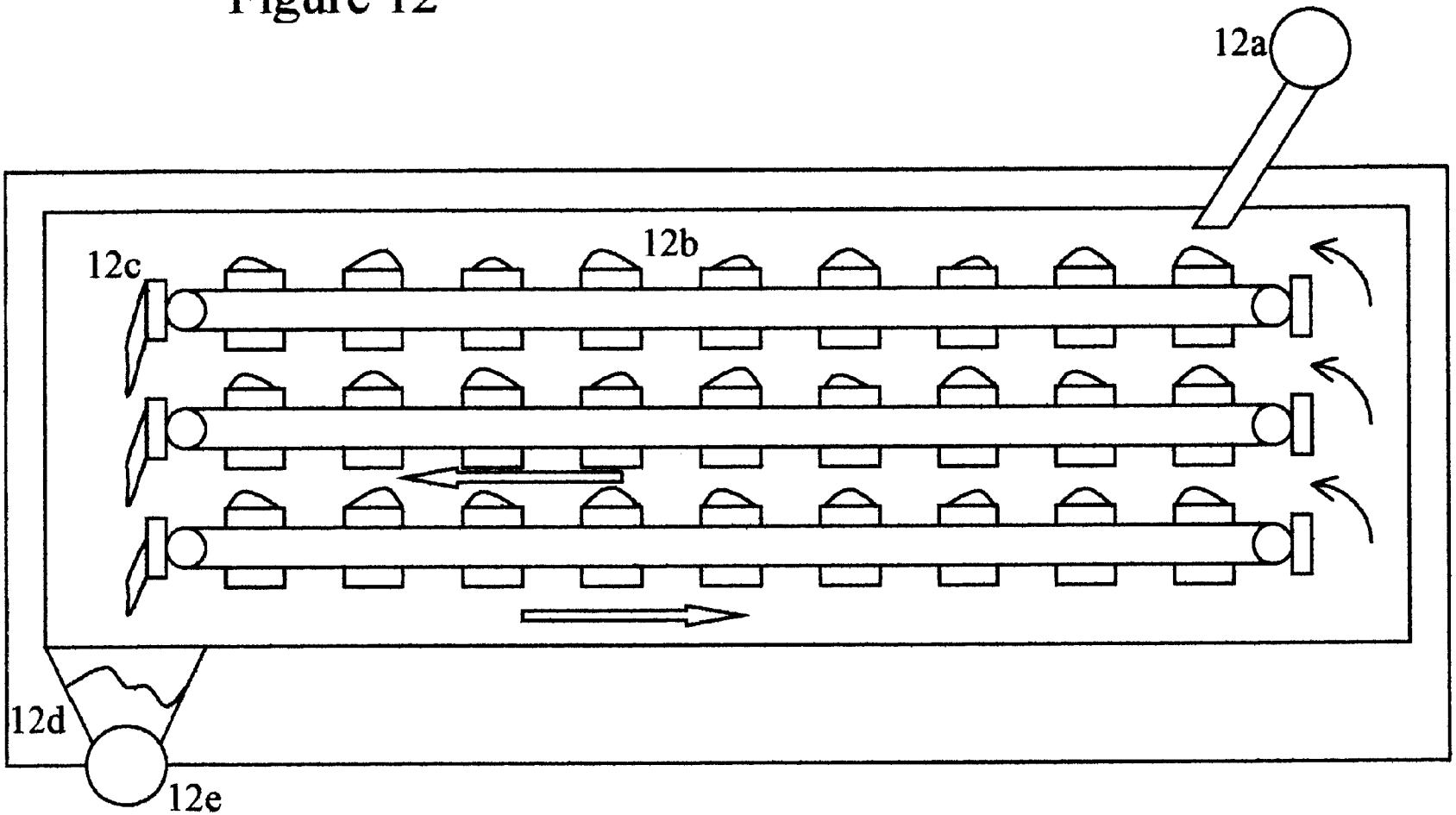
FIG. 12 shows a transfer device in the form of a conveyor with carrying trays.
Figure 13:
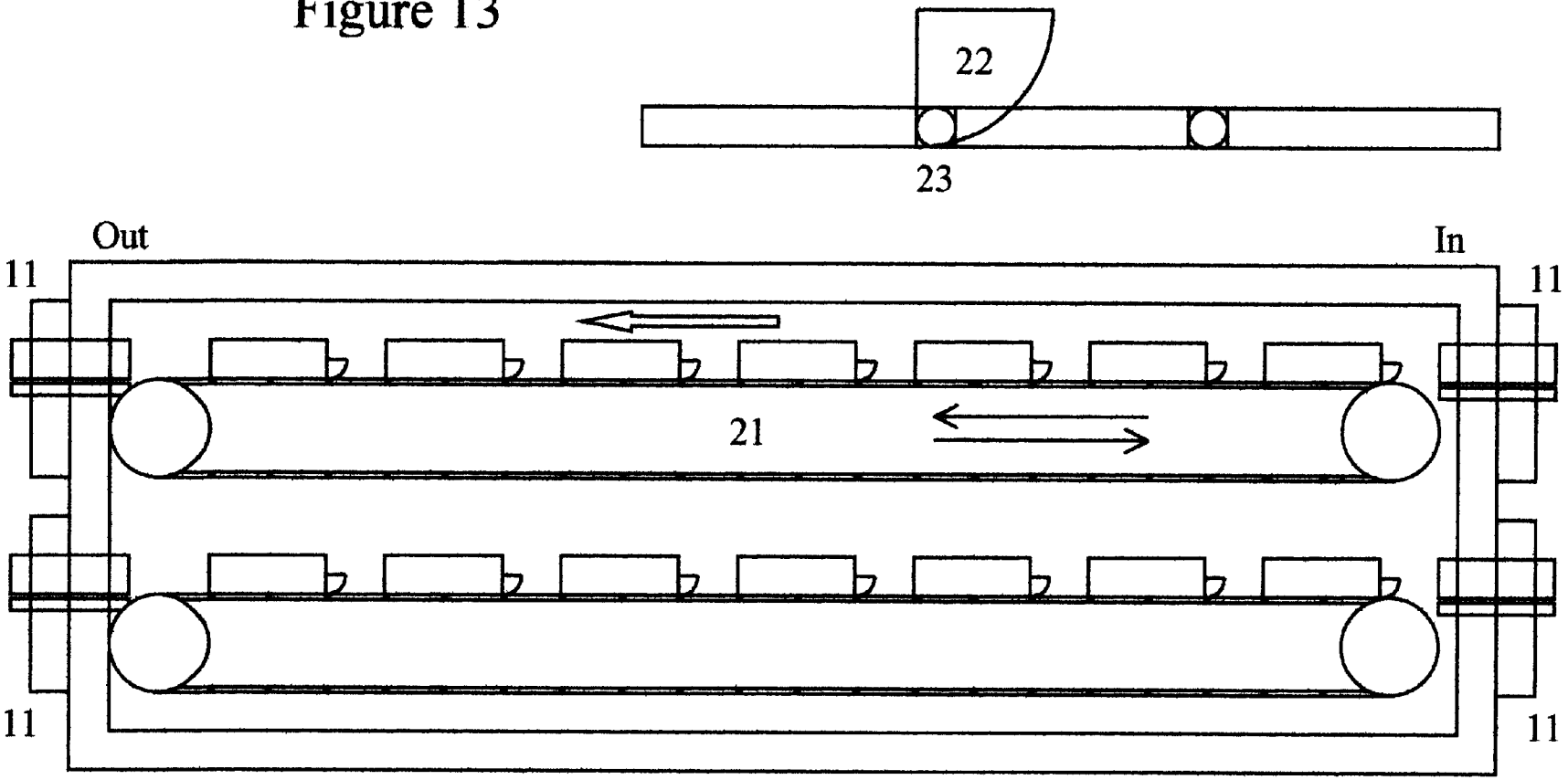
FIG. 13 shows a transfer device in the form of an oscillating shuttle.
Figure 14:
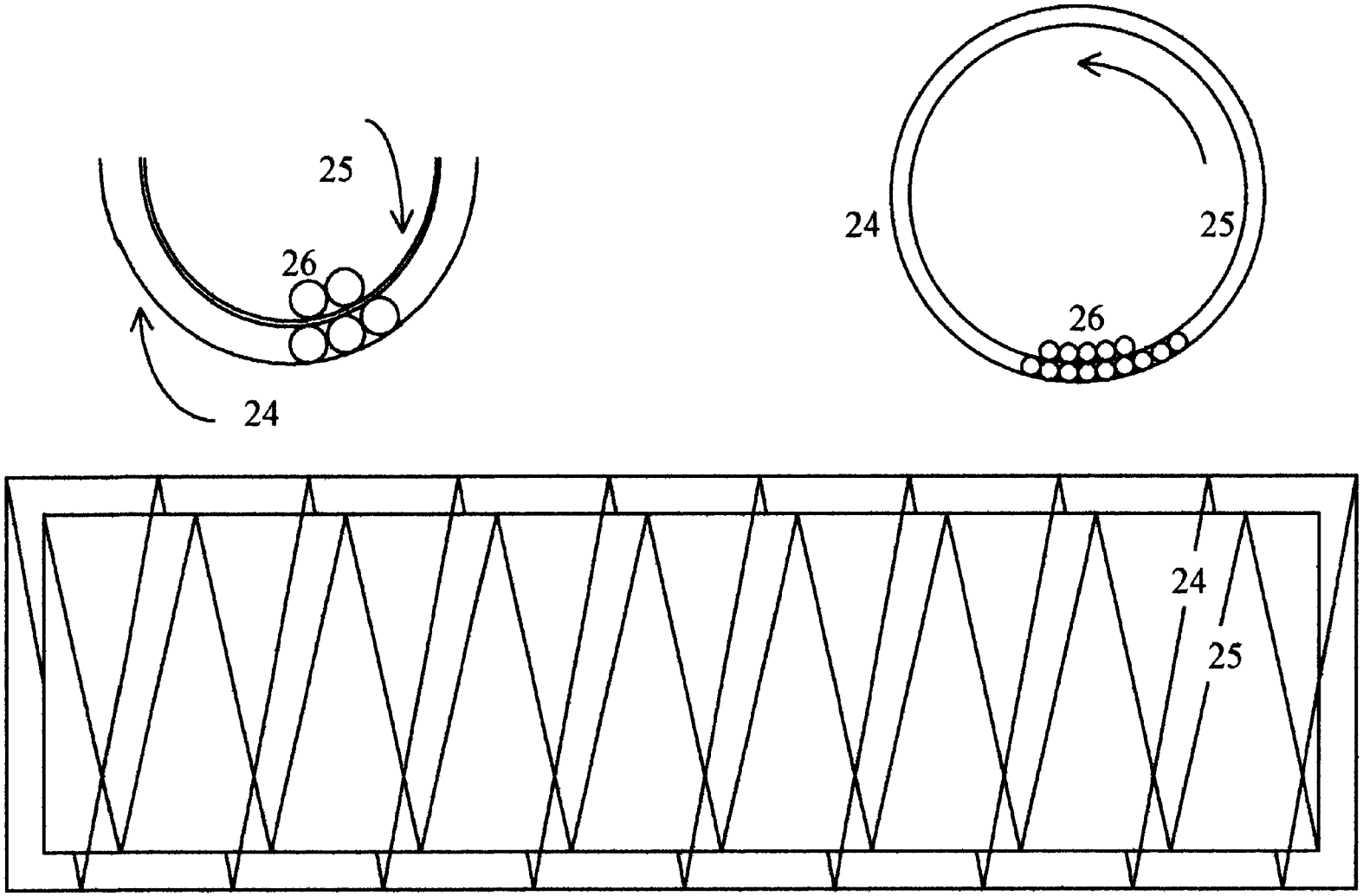
FIG. 14 shows in elevation and cross sectional views a transfer device in the form of a double helix including circulating balls.

FIGS. 11 to 14 show various apparatus for conveying the feedstock through the transfer chamber 5 via one of a number of transfer devices, namely:

| | | |
|---|---|---|
| FIG. 11 | 5a | A rotary drum with lifting flights |
| FIG. 12 | 5b | A conveyer with or without carrying trays |
| FIG. 13 | 5f | A shuttle |
| FIG. 14 | 5g | A double helix with circulating balls |

Which of these is most suitable will depend upon the physical characteristics of the feedstock. Since many organic feedstocks will tend to stick together under pressure, a large volume low velocity system will be most suitable most frequently and this tends to lead to the rotary drum, conveyer with trays or shuttle being selected most often. A smaller volume higher velocity systems will tend to be chosen for feedstocks such as seeds which do not tend to coalesce in lumps and have small unit volume thus reducing time for moisture migrating through the particle.

In the rotary drum with lifting flights, in order to maximise heat transfer, there may be provided two separate flows of feedstock. As the product in the lifting flights falls as a curtain, it collects heat directly from the superheated vapour. The lifting flight trays are held at a distance from the drum, thereby producing an annular space through which the remainder of the feedstock may flow and collect additional heat from the wall of the drum, which has itself been heated by the superheated vapour.

A system where gravity is utilised to a maximum and contact between feedstock and surfaces of the apparatus are at a minimum will often be most suitable for the drying of sludges and distillation of essential oils and aqueous solutions therefrom.

When the feedstock has entered into the transfer chamber 5, it ceases to be feedstock as it starts to lose its moisture and it becomes material in process. It will remain as material in process for the residence time that it spends in the transfer chamber 5. The method requires that the residence time is determined to be sufficiently long that the required percentage of moisture has been removed from each particle and thus from the mass of feedstock as a whole. This residence time will vary with the physical characteristics of each feedstock. The residence time will normally be several minutes and it may well run into a few hours for some feedstocks. The length of this broadly selected residence time will dictate the selection of the transfer mechanism in the transfer chamber 5 and the length and the cross sectional area of the transfer chamber 5.

The precise residence time on a minute by minute or hour by hour basis may be adjusted by a variable speed drive which controls (*a*) the rotational speed of the drum for a rotary drum (*b*) the drive speed for a conveyer and (*c*) the stroke frequency for a shuttle and by adjusting the infeed rate of feedstock through the feedstock input means 2 and differential pressure between hot plenum chamber 4 and warm plenum chamber 6 created by the fan 14.

FIG. 14 shows an embodiment of transfer 5 in which the rotatable drum pushing the moist feedstock is provided with an internal double helix within which run balls 26. The balls 26 rotate along a helical pathway 24 adjacent the surface of the drum and return along a helical pathway 25 in a converse direction. Movement of the balls disturbs the moist feedstock so that it does not stick to the surface of the drum and new faces thereof are presented to the superheated vapour. The heavy balls have a high mass and specific heat, and thereby cause increased heat transfer into the organic mass.

Figure 15:
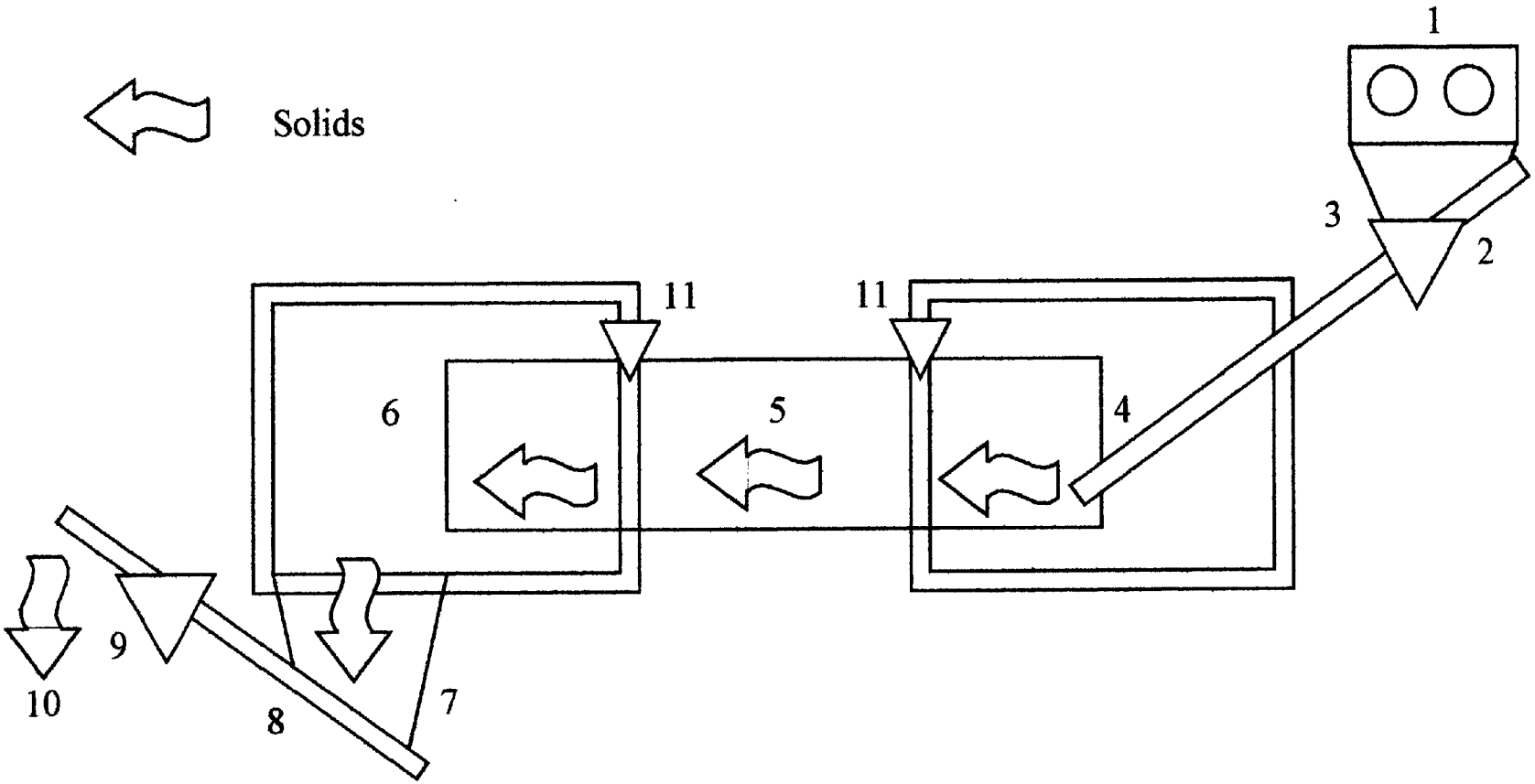
FIG. 15 shows schematically solid fraction collection means.

Referring now to FIG. 15, on completion of the residence time, the material in process becomes finished end product and this is discharged from the transfer chamber 5 into a solid fraction collector 7 situated in the warm plenum chamber 6. From the warm plenum chamber 6 the finished product comprising the separated solid fraction is removed by the solid fraction conveyor 8 which is provided with a steam buffer 9 operating on the same principles as that on the feedstock input 3, previously described. The solids leave the apparatus at this point and are loaded to transport vehicles or are stored in silos or hoppers awaiting onward despatch, using conventional methods outside the scope of this application.

When any organic feedstock enters the apparatus it may well contain a significant quantity of air, which naturally occurs in the surface pores of organic materials and there is more air or other gases which are entrapped by the loosely mixed particles of the feedstock. Under the action of heat, the air expands within the feedstock and migrates and is released into the flow of superheated vapour circulating in the apparatus. The flow of feedstock in and dried solid product out keeps a continuous flow of air in and out, which is added to by ingress of air from the various steam buffer means 9. The presence of air in the system is inevitable and it can be viewed as both beneficial and detrimental due to its greater density than that of superheated steam, provided it does not become the dominant source of heating for the various particles comprising the material in process.

Figure 16:
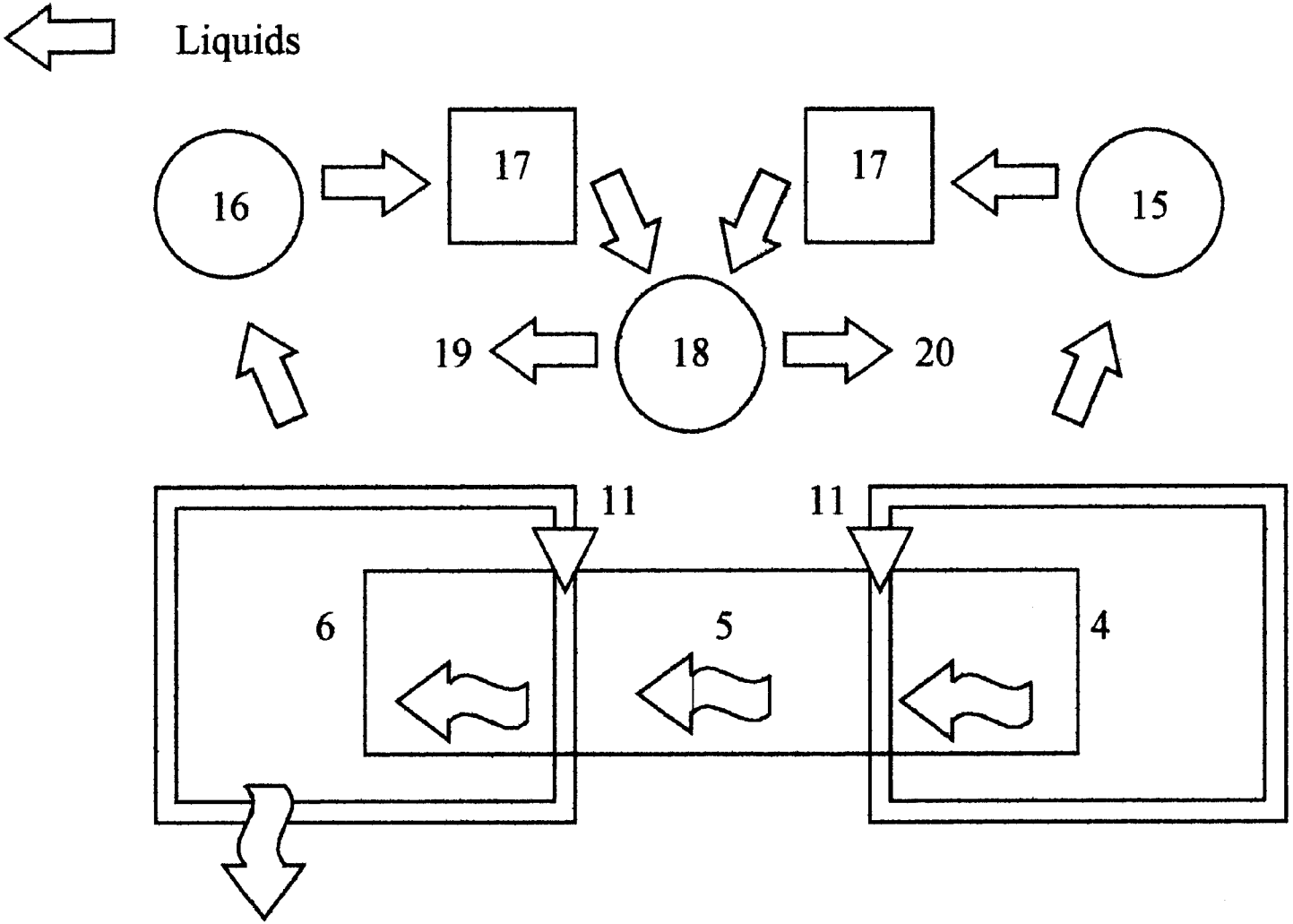
FIG.16 shows schematically the vapour flow during condensation.

With regard to FIG. 16, liquid fraction collection means and associated means are shown. The contact of self-generated superheated vapour at high temperature with the material in process causes the oil glands, sacs and intercellular spaces to release their secretions and causes these no longer secreted substances to migrate to the surface of the particle of organic matter from which they derive. At the same time, the raising of temperature of the particle of organic matter has caused the water based solutions which comprise the largest part of the moisture in the particle also to migrate to the surface of the particle. The liquids at the particle surface are generally immiscible and thus they need to evaporate from a two-phase liquid on the surface of each particle into a two-phase vapour which, after collecting together many such droplets, becomes the source of the vapour which is fed into the low temperature side of the heat exchange means 14 and emerges having had its temperature raised to the desired superheated vapour temperature. In a typical apparatus for extracting aromatic oils from citrus residues, the main body of vapour circulates at 2,000 cubic meters per minute and the whole apparatus contains some 200 cubic meters capacity. Thus the main body of vapour is being exposed to the material in process and cooled by this contact then recirculated and reheated to return again some one tenth of a minute or six seconds later when it will encounter another particle. Clearly the size of the apparatus and the temperature of recirculation can vary widely and the frequency of contact may vary from less than a second to more than one minute, but this example serves to illustrate the method and principle inherent in the invention.

Clearly, as each particle releases the two-phase liquid into vapour form and new particles are arriving in the apparatus all the time, the amount of vapour in circulation in the apparatus would build up continuously if some of the newly generated vapour were not removed. The method therefore provides for the removal of vapour from the apparatus at a rate broadly equivalent to the rate at which new vapour is being added to the body of vapour in circulation. This balance is important because too much steam/vapour removed will leave the system containing mostly air and the air is relatively very inefficient at removing the oils from their oil glands, sacs and intercellular cavities than is the steam/vapour. As less two-phase liquid is present the necessary temperature required to evaporate the liquid at the particle surface rises and evaporation reduces. Conversely, if too little vapour is removed, the superheated steam in the vapour will become wetter and wetter until eventually it becomes saturated and unable to absorb more moisture at which time evaporation will cease. There are two alternative methods of control to ensure a broadly steady state condition is maintained. If the rate of extraction of the vapour from the apparatus is fixed, then the rate of feed of the feedstock must be increased or decreased to maintain the balance or if the rate of feed is fixed then the rate of extraction of vapour may be varied up or down to suit. Experience indicates that once the steady state is achieved, little adjustment is normally required, but establishing a balance can be a very complex exercise when experience with the particular feedstock and its particular characteristics is limited.

The apparatus provides four principal points at which vapour may be extracted, namely on the low temperature side 6, 12 and the high temperature side 14, 4 of the transfer chamber 5 at high and low levels respectively. The apparatus provides for two vapour extraction means of which one or other may best fit any particular application or both may be of benefit. The hot vapour extraction means 15 is situated at a point where the temperature is highest and it may draw from either low level where the densest wetter air/vapour generally exists or at high level where the least dense drier vapour generally exists. Similarly the warm vapour extraction means 16 is situated at the outlet of the warm plenum chamber 6 and also has low level and high level collection alternatives.

Vapour drawn from one or more of the alternative extract points in the apparatus is carried via a duct or ducts to one or more condensers. The hot condensing means 17 and/or the warm condensing means 17 may be used independently to condense vapours from the hot vapour extraction means 15 and the warm vapour extraction means 16 or the two flows of vapour may be combined into one combined condenser or there may only be one vapour extraction means and one condensing means. This selection depends on whether the apparatus is being used solely as a drier or as a combined distillation/drying processor or as a distillation processor and on whether the vapours of the secreted substances removed, if any, are heavier or lighter than the vapour produced from the water based solutions. The liquids flowing from the condensers may go to secretions separation means 18, if separation has not occurred during the condensation process.

Either the hot condensing means 17 or the warm condensing means 17 may serve to condense all the vapours or be set to condense only the water based solutions and the immiscible vapours may remain in vapour form.

If the liquid flowing from the hot condensing means 17 and/or the warm condensing means 17 into the secretions separation means 18 contains both the aqueous water based solutions and the immiscible secreted substances in commercially viable percentages, then separation is required. Since the liquids are immiscible, any fraction lighter than the water based solution will float to the top of a vessel and any fraction more dense than the water based solution will settle to the bottom. A secretions separating means 18 can draw light fractions from the top surface or dense fractions from the bottom connection. The fractions extracted may contain some of the water based solution and this solution may be considered a contaminant. The method provides for this contamination to be removed by means of a centrifuge separator, if required.

Where the vapour from the secreted substances, being largely immiscible with the water based solutions condensed in the hot condensing means 17 or the warm condensing means 17 are released from the condensing means as a mist of small droplets, these may be collected by a mist condenser collector forming part of the secretions separating means 18. The separated condensed wet fractions are discharged as a water soluble fraction via one outlet 19 and a water immiscible fraction via another outlet 20.

Advantages given by the method include operation without emission of smell or odour, and therefore the apparatus requires no secondary air scrubbing systems. The use of superheated steam and air mixture instead of hot air alone as the drying medium, with control and moderation of oxygen from the drying process to a level sufficient to inhibit combustion prevents fires due to overheating, and distinguishes this invention from normal direct fired driers.

The apparatus includes a number of features to enclose the vapours and odours to ensure the apparatus is environmentally benign. One example is use of steam buffers at a small pressure differential over the operating pressure to prevent vapours escaping at (i) feedstock infeed; (ii) dried product outfeed and (iii) at any rotary or sliding movement points.

The invention includes a number of features in the apparatus to convey the material in process through a transfer vessel which are so arranged that sufficient surface area is exposed to the superheated vapour. One example is use of annular flow to give larger particles more residence time whilst exposing them repeatedly to a newly heated metal surface.

Another feature improves condensation of secreted substances from a two-phase liquid. One example is use of coils in a cooled tube or a mesh in a cooled enclosure or use of a packed column.

Another feature of the apparatus is to control the flow of superheated air/vapour mixtures to improve thermal efficiency. The properties of a two-phase superheated vapour which has a high specific heat and low density generally means that it is therefore a better drying medium than air at the same temperature, since the air generally has a lower specific heat and higher density. The invention provides that the two-phase superheated vapour concentrates the hottest steam in the highest parts of the apparatus where it is most effective in transferring heat to the metal parts of the apparatus, which, in turn, transfers heat to the material in process.

Thus, the method and apparatus of the invention has a number of advantages, namely that the entire process is enclosed to avoid emissions to the atmosphere which, with non-enclosed conventional alternatives, would lead to odours or emission of noxious or deleterious substances into the atmosphere.

Also it is able to divert into commercially profitable products many organic wastes that would otherwise go to landfill or decompose randomly into uncontrolled field drainage.

Furthermore it excludes ingress of surrounding atmosphere which may carry organisms that will grow on a nutrient source, and the feedstock is exposed to sufficient time at the pathogen kill zone temperatures to provide sterile products, fit for use.

By allowing control of the mixture of steam and air at levels below the amount of oxygen needed to support combustion, it avoids risk of combustion of the flammable vapours produced by certain secreted substances and which is a common problem with earlier attempts to dry such organic residues in a conventional direct fired drier.

Furthermore the process offers higher yields of recovering essential citrus oils from citrus peels or pulp than is possible by conventional methods, while by-products from the process comprise dried citrus meal of high quality which can be sold in the animal food markets and aqueous solutions containing water soluble extracts which comprise a number of substances that can be sold in the flavour and flavour enhancement markets along with the essential oils.

Finally the overall process is very energy efficient.

We claim:

1. An apparatus for drying organic material, comprising a substantially sealed chamber, means sealingly to admit said organic material and a predetermined amount of air thereto, means sealingly to discharge dried organic material therefrom, heat exchanger means to recirculate gases within the chamber back to the chamber at a higher temperature, means to extract a proportion of the gases, being essentially steam, air and essential oils, from said chamber, means to condense said extracted gases and separate said condensates into aqueous and organic fractions.

2. An apparatus as claimed in claim 1, wherein the sealed chamber comprises a rotatable drum within the substantially sealed plenum chamber.

3. An apparatus as claimed in either claim 1 or claim 2, wherein the means to admit said material comprises a substantially sealed downwardly directed conveyor means.

4. An apparatus as claimed in either claim 1 or claim 2, wherein the means to admit said material comprises a sealed double hopper means.

5. An apparatus as claimed in either claim 1 or claim 2, wherein the means to admit said material comprises rotatable hopper means having a plurality of segments, substantially sealed one from another.

6. An apparatus as claimed in either claim 1 or claim 2, wherein the means to discharge dried material comprises a screw conveyor or sealed hopper means.

7. An apparatus as claimed in claim 2, wherein the sealed chamber includes a rotary drum with lifter plates, means to drive rotatably said drum at a speed which is so variable as to control the speed at which the organic material is transported through the system, means to duct air into a mount of the rotary drum and recirculate it via heater means, said heated moisture caused by drying said material being recirculated continuously via said heater means and said drum to cause evaporation of moisture from the fruit or other organic material.

8. An apparatus, as claimed in claim 7, wherein dried material is ejected from the end of the drum into a hopper system in such a manner as to ensure air is allowed to enter the system only in predetermined quantities.

9. An apparatus as claimed in claim 1, wherein superheated steam, air, particles, and essential oil vapours are bled from the system via a duct into condenser means.

10. An apparatus as claimed in claim 9, further comprising a distillation system wherein essential oils and aqueous solutions thereof are separated from gases, vapour or any particles retrieved from said condenser means into liquid condensate forms.

11. A method of drying organic materials comprising the steps of so feeding said organic material that only a predetermined amount of air is admitted therewith, heating the material by means of said air and steam generated by heating of the material, recirculating said air and steam to reheat it to a temperature between 120–250° C. preferably in the region of 200° C. and readmit it to the organic material,so removing dried organic material that substantially none of the air, steam and any essential oils entrained therewith are removed therewith, removing a proportion of the air, steam and essential oil vapour, and condensing said removed proportion to separate it into its component parts.

12. A method of extracting aromatic oils from citrus fruit, its pulp, or its peel or other organic material, comprising passing the fruit into a substantially sealed processing means in such a manner that air is admitted at a controlled rate; heating said fruit or material by means of a recirculating gaseous stream containing steam self-generated by evaporation of moisture from the fruit and heated by passing through heat exchanger means; so discharging dried fruit or material from said processing means that steam and air are retained within the drier; passing a portion of said gaseous stream including generated steam, essential oil, and air to condensing means, and separating the thus condensed portion of the stream into an essential oil fraction and an aqueous fraction.

13. A method as claimed in claim 12, wherein the fruit or material is initially shredded or otherwise comminuted before being fed to the drying means.

14. A method as claimed in either claim 12 or claim 13, wherein organic material including citrus fruit, as whole fruit, pulp or peel is first comminuted in a shredder and then fed into a drying system via means to admit air into the system at such a rate as to avoid combustion or excessive oxidation of any essential oils.

* * * * *